US010753683B2

(12) United States Patent
Blais et al.

(10) Patent No.: US 10,753,683 B2
(45) Date of Patent: Aug. 25, 2020

(54) DEVICE AND SYSTEM FOR GAS INJECTION IN AND EXTRACTION FROM A BUILDING STRUCTURE

(71) Applicant: ASSEK TECHNOLOGIE, Levis (CA)

(72) Inventors: Jean-Pierre Blais, Levis (CA); Mario Lavoie, Quebec (CA); Guillaume Blais, Levis (CA); Clemente Ibarra, Quebec (CA)

(73) Assignee: ASSEK TECHNOLOGIE, Levis (CA)

( * ) Notice: Subject to any disclaimer, the term of this patent is extended or adjusted under 35 U.S.C. 154(b) by 97 days.

(21) Appl. No.: 15/987,425

(22) Filed: May 23, 2018

(65) Prior Publication Data

US 2018/0340733 A1 Nov. 29, 2018

Related U.S. Application Data

(60) Provisional application No. 62/509,896, filed on May 23, 2017.

(51) Int. Cl.

| | |
|---|---|
| ***F26B 5/04*** | (2006.01) |
| ***F26B 21/00*** | (2006.01) |
| ***E04B 1/70*** | (2006.01) |
| ***E04G 23/02*** | (2006.01) |

(52) U.S. Cl.

CPC ..... *F26B 21/001* (2013.01); *E04B 1/7069* (2013.01); *E04B 1/7092* (2013.01); *E04G 23/02* (2013.01); *E04G 23/0296* (2013.01)

(58) Field of Classification Search

CPC ..... F26B 3/02; F26B 3/04; F26B 3/06; F26B 21/001; E04G 23/0296; E04G 23/02; E04B 1/70; E04B 1/7092; E04B 1/7069

USPC ..... 34/413, 443, 467, 476

See application file for complete search history.

(56) References Cited

U.S. PATENT DOCUMENTS

| | | | | |
|---|---|---|---|---|
| 2,122,964 | A | 7/1938 | Sweetland | |
| 3,007,256 | A | 11/1961 | Rouy | |
| 3,487,557 | A | 1/1970 | Linstead | |
| 4,306,490 | A | 12/1981 | Kallestad et al. | |
| 5,214,860 | A | 6/1993 | Landes | |
| 5,611,151 | A * | 3/1997 | Jacob | F26B 21/004 34/395 |
| 5,968,401 | A | 10/1999 | Roy | |
| 7,007,403 | B1 | 3/2006 | Studebaker | |
| 7,785,064 | B2 | 8/2010 | Bartholmey et al. | |
| 7,841,087 | B1 | 11/2010 | Walker, Jr. | |
| 8,132,831 | B1 | 3/2012 | Walker, Jr. | |
| 8,468,716 | B1 * | 6/2013 | Walker | E04B 1/7092 15/405 |
| 8,579,582 | B1 | 11/2013 | Gehring | |

(Continued)

FOREIGN PATENT DOCUMENTS

WO 2010007380 A2 1/2010

*Primary Examiner* — John P McCormack
(74) *Attorney, Agent, or Firm* — BCF LLP

(57) ABSTRACT

The present disclosure relates to a device and a system for gas injection in cavities of building structures, particularly for drying, decontaminating or drying and decontaminating building structures. The present disclosure also relates to a device and a system for gas extraction from cavities of building structures, particularly for drying, or for drying and decontaminating building structures. The present disclosure also generally relates to a system for monitoring parameters of a gas injection/extraction process using the device and system provided herein.

18 Claims, 24 Drawing Sheets

(56) References Cited

U.S. PATENT DOCUMENTS

| | | | | |
|---|---|---|---|---|
| 8,593,808 | B2 | 11/2013 | Pal et al. | |
| 9,051,727 | B1 * | 6/2015 | Carlton | F26B 9/003 |
| 2003/0056390 | A1 * | 3/2003 | Adrian | F24H 1/06 34/79 |
| 2004/0111912 | A1 | 6/2004 | Storrer | |
| 2004/0255484 | A1 | 12/2004 | Storrer et al. | |
| 2006/0272176 | A1 | 12/2006 | Elliott et al. | |
| 2007/0227163 | A1 | 10/2007 | Storrer et al. | |
| 2009/0025323 | A1 | 1/2009 | Fernandes | |
| 2009/0304492 | A1 | 12/2009 | Bartholmey et al. | |
| 2010/0011612 | A1 * | 1/2010 | Jayne | E04B 1/7069 34/417 |
| 2011/0059228 | A1 * | 3/2011 | Gillick | F26B 21/004 427/2.25 |
| 2013/0251863 | A1 * | 9/2013 | Yousef | A23B 5/005 426/298 |
| 2017/0191756 | A1 * | 7/2017 | Jayne | F26B 9/003 |

* cited by examiner

DEVICE AND SYSTEM FOR GAS INJECTION IN AND EXTRACTION FROM A BUILDING STRUCTURE

CROSS-REFERENCE TO RELATED APPLICATION

This application claims the benefit of and priority to U.S. provisional patent application No. 62/509,896, filed on May 23, 2017, the content of which is herein incorporated in this entirety by reference.

FIELD OF TECHNOLOGY

The present disclosure generally relates to a device and a system for gas injection in cavities of building structures (e.g., wall, floor and/or ceiling), particularly for drying, decontaminating or drying and decontaminating building structures. The present disclosure also generally relates to a system for monitoring parameters of a gas injection process using the device and system provided herein.

BACKGROUND OF TECHNOLOGY

The typical approach for drying walls damaged by water is to install air movers (e.g., air fans) directing the air flow towards the affected areas. The air inside the room is sometimes conditioned with heating and/or dehumidification equipment to improve drying. Such configuration is not optimal in terms of energy consumption and drying time. Often, restoration is not successful, mold appears and building owners need to reconstruct.

There is a need for fast drying (typically under 48 hours for drywall structures) to avoid rebuilding, to reduce the impact on business interruption and to reduce the risk of cross-contamination. Furthermore, proper decontamination measures need to be addressed when required.

Different methods and systems have been proposed over the years to deal with these situations. One approach suggests the use of directional drying fans in order to direct the air flow where needed. For instance, U.S. Pat. No. 7,331,759, incorporated herein by reference, relates to an axial drying fan especially conceived for directing air flow to specific locations such as to corners at the intersection of wall/floor Another tactic is to use heat exchangers in order to transfer part of the energy (heat) from the warm (and humid) air in the building before replacing it with the dry (and cold) air from the outside. For instance, U.S. Pat. No. 6,457,258, incorporated herein by reference, discloses a portable drying system mounted on a trailer. The system uses a counter-current heat exchanger to transfer part of the heat from the exhausting air to the entering air in order to increase temperature. The system further heats the entering air with a propane heater. U.S. Pat. No. 6,662,467, incorporated herein by reference, presents a similar system but adapted to elevated buildings. The air is heated to 125° F. (52° C.) and relative humidity is drawn to 5% using a propane heater. U.S. Pat. No. 2006/0189270, incorporated herein by reference, further proposed to combine the heat exchanger with a building positive pressurization and controlling the exiting flow of air to maintaining the desired positive pressure inside the building. In such a way, humid air from inside the building will flow through cracks and openings to the outside carrying humidity. Air from the outside is conditioned (dried and/or heated) before flowing to the inside. U.S. Pat. No. 2006/0185819, incorporated herein by reference, proposes a portable heat exchanger driven by a fan. Outside air is first cooled to remove humidity and then heated-up before entering the treated room. In all these cases, drying achieved by venting the affected rooms with large volumes of air being moved around and as a result, the building cannot be occupied during the drying procedure.

Injection systems have also been proposed with the purpose of substantially reducing the volume of air to be treated, which is more convenient when dealing with cavities such as walls and ceilings. For example, U.S. Pat. No. 8,468,716, incorporated herein by reference, discloses an injection drying system comprising a blower to which a plurality of flexible hoses are connected at one end and inserted into the wall at the other end. Pressurized air enters the wall cavity to speed up drying. U.S. Pat. No. 5,155,924, incorporated herein by reference, proposes an injection system specifically conceived for tongue-in-groove flooring. A set of diverters are provided for drying inside walls, floors and ceilings. The injection system combines the use of a dehumidifier and/or a heater as well as an exhaust conduit to reduce humidity before reinjecting air into the treated areas. U.S. Pat. No. 5,408,759, incorporated herein by reference, discloses a device comprising a flexible/expandable bag (air impermeable fabric or sheet material) with several air conduits adapted to be inserted into holes in the wall, forcing air from a blower device into walls cavities. Several bags can be inter-connected for large areas. U.S. Pat. No. 5,893,216, incorporated herein by reference, proposes an air distribution unit having several conduits of varying cross-section and length with nozzles attached in order to be inserted into the wall through perforated holes. The unit can inject air into the cavities and/or extract air form it. Small holes need to be drilled into the walls and repaired after drying. U.S. Pat. No. 6,647,639, incorporated herein by reference, discloses an improved forced air system for drying walls, which is driven by a blower in an open or closed loop configuration and operated in positive (injection) or negative (vacuum) pressure. The system uses injectors with an innovative locking tab mechanism and anti-clogging system. U.S. Pat. No. 6,886,271, incorporated herein by reference, extends the use of this system for floor drying by connecting the injectors to a floor plate. All these systems work on the air injection principle which require making holes on walls that need to be repaired after drying.

Alternatively, other methods preconize the use of existing holes in the wall in order to avoid perforating the walls. For instance, U.S. Pat. No. 5,761,827, incorporated herein by reference, discloses a process by which pressurized air is injected into hollow walls through existing holes around water supply piping for toilets, eliminating the need to drill new holes and repair them after drying. U.S. Pat. No. 5,555,643, incorporated herein by reference, describes an apparatus for injecting (or extracting) air to (or from) a wall cavity through electrical boxes, which provide access to (portions) of the wall cavities. U.S. Pat. No. 8,978,270, incorporated herein by reference, presents a method for drying a wall cavity also through light switches of power outlets. These systems are however limited to the wall cavity areas that can be reached from the existing holes locations.

Yet another injection approach consists on targeting interior layers of sheathing for the specific case when moisture locates on the outside side of sheathing, not easily accessible from the inside. U.S. Pat. No. 5,960,556, incorporated herein by reference, discloses a system for drying interior layers of sheathing in narrow wall spaces. It uses nozzles with circumferential orifices that, once they are inserted into the wall structure through proper holes perforated for this purpose, face the targeted wall spaces between layers.

Besides the drying methods, there have also been some efforts to develop control and monitoring software to assist the drying procedure. U.S. Pat. No. 9,015,960, incorporated herein by reference, discusses a drying apparatus comprising a heating system operated to rise temperature to the desired level, a conduit to exhaust humid air out of the room when required, and a set of sensors to control temperature and humidity within the treated room. The apparatus works continuously until the optimal humidity is reached. U.S. Pat. No. 7,403,126 discloses an apparatus, system and method to provide drying procedure information through a user interface. U.S. Pat. No. 8,006,407, incorporated herein by reference, presents a drying system that provides enhanced drying through the use of remote sensors and control devices. U.S. Pat. No. 2006/0185838, incorporated herein by reference, discloses a method to control humidity through the use of heat exchangers comprising heating elements that operate when needed to reduce the relative humidity of the air entering the dried space.

Furthermore, when a structure is affected by water damage, possible contamination by molds is an additional concern besides drying. Molds spores are present everywhere, inside and outside buildings, and normally do not constitute a problem for human health or materials integrity. However, when favorable conditions (nutrients, temperature and humidity) are met, mold spores that have settled inside a building, for instance inside wall cavities, can grow at a fast pace. Therefore, a goal of water damage restoration is to dry and also to decontaminate the affected structures when needed to avoid rebuilding, which also implies a loss in time, money and user comfort.

In this sense, U.S. Pat. Nos. 5,408,759 and 5,960,556, both cited before, also mentioned the possibility to inject deodorants, disinfectants, fungicidal or 'other treatments' into the wall cavities. U.S. Pat. No. 7,357,831, incorporated herein by reference, proposes a combined approach to control humidity and mold through a heat exchanger (similar to the ones described above) and to add HEPA filters and UV lights to kill mold spores flowing in the air stream. U.S. Pat. No. 6,327,812, incorporated herein by reference, proposes a method of killing organisms and removing substantially the remains from the treated enclosure. It is based on heating-up the building surfaces to temperatures between 120-300° F., supposedly killing several microorganisms (mold, insects, bacteria, etc.). The combined use of ozone is preferred to increase effectiveness. U.S. Pat. No. 6,892,491, incorporated herein by reference, further improves this system by creating a negative pressure within the treated space and by increasing the air temperature heating range to 110-400° F. U.S. Pat. No. 2005/0066537, incorporated herein by reference, discloses a system for wall cavity decontamination by injecting and/or extracting air or biocides. The method includes an evacuation phase (to remove existing contaminants) that can be performed in extraction, injection or close-loop modes, a decontamination phase that is performed by exposing the contaminants to microwave radiation and/or biocides, and a lock-down phase to trap the remaining (non-viable) contaminants into the cavity.

In view of this, there remains a need in the art for a system for wall restoration after water damage that is compact, easy to use, more efficient and safe, that provides the possibility to effectively dry structures (e.g., wall structures) and decontaminate them when required.

SUMMARY OF TECHNOLOGY

According to various aspects, the present technology relates to a gas injection device for drying and/or decontamination of a building structure, the gas injection device comprising an injector module, the injector module having an inner lumen defined by as external wall, the external wall defining a distal insertion portion for insertion of the injector module into the building structure and a proximal ventilation portion for providing air flow into the inner lumen of the injector module, the distal insertion portion and the proximal ventilation portion being in fluid communication with one another through the inner lumen, wherein the wall of the proximal ventilation portion comprises a plurality of ventilation openings configured to direct air flow into the inner lumen of the injector module.

According to various aspects, the present technology relates to a gas injection device for injection of gas into a cavity in a building structure, the gas injection device comprising: an injector module; a ventilation module; a casing module for assembling the ventilation module with the injector module; and a noise reduction module connected to the casing module.

According to various aspects, the present technology relates to a gas injection device for injection of gas into a building structure, the gas injection device comprising: an injector module; a ventilation module; a casing module for assembling the ventilation module with the injector module; and an injection duct connected to the casing module.

According to various aspects, the present technology relates to a gas extraction device for drying and/or decontamination of a building structure, the gas extraction device comprising an extractor module, the extractor module having an inner lumen defined by as external wall, the external wall defining a distal insertion portion for insertion of the extractor module into the building structure and a proximal ventilation portion for providing air flow into the inner lumen of the extractor module, the distal insertion portion and the proximal ventilation portion being in fluid communication with one another through the inner lumen, wherein the wall of the proximal ventilation portion comprises a plurality of ventilation openings configured to direct air flow into the inner lumen of the extractor module.

According to various aspects, the present technology relates to a gas extraction device for extraction of a gas from a building structure, the gas extraction device comprising: an extractor module; a ventilation module; a casing module for assembling the ventilation module with the extractor module; and a noise reduction module connected to the casing module.

According to various aspects, the present technology relates to a gas extraction device for extraction of gas from a building structure, the gas extraction device comprising: an extractor module; a ventilation module; a casing module for assembling the ventilation module with the extractor module; and an injection duct connected to the casing module.

According to various aspects, the present technology relates to a gas injection system for injection of a gas into a building structure, the gas injection system comprising: a distribution unit; one or more gas injection device as defined herein, in fluid communication with the distribution unit; and a drying module in fluid communication with the distribution unit.

According to various aspects, the present technology relates to a gas extraction system for extraction of a gas from a building structure, the gas extraction system comprising: one or more gas extraction device as defined herein; and a gas recirculation module in fluid communication with the one or more gas extraction device.

According to various aspects, the present technology relates to a gas circulation system for circulation of a gas into a building structure, the gas injection system comprising: a gas injection unit comprising a gas distribution unit in fluid communication with one or more gas injection device; a gas extraction unit comprising a gas recirculation module in fluid communication with one or more gas extraction device; and a gas generator in fluid communication with the gas injection unit and the gas extraction unit.

According to various aspects, the present technology relates to a gas injection device for injection of gas into a building structure, the gas injection device comprising: an injector module; a casing module for assembly with the injector module; and a noise reduction module connected to the casing module; wherein the injector module comprises a plurality of ventilation openings for allowing air into the injector module.

According to various aspects, the present technology relates to a gas injection device for injection of gas into a building structure, the gas injection device comprising: an injector module; a casing module for assembly with the injector module; and an injection duct connected to the casing module; wherein the injector module comprises a plurality of ventilation openings for allowing air into the injector module.

According to various aspects, the present technology relates to a gas extraction device for extraction of a gas from a building structure, the gas extraction device comprising: an extractor module; a casing module for assembly with the extractor module; and a noise reduction module connected to the casing module; wherein the extractor module comprises a plurality of ventilation openings for allowing air into the extractor module.

According to various aspects, the present technology relates to a gas extraction device for extraction of gas from a building structure, the gas extraction device comprising: an extractor module; a casing module for assembly with the extractor module; and an injection duct connected to the casing module; wherein the extractor module comprises a plurality of ventilation openings for allowing air into the extractor module.

Other aspects and features of the present technology will become apparent to those ordinarily skilled in the art upon review of the following description of specific embodiments in conjunction with the accompanying drawings.

BRIEF DESCRIPTION OF DRAWINGS

Further features and advantages of the present disclosure will become apparent from the following detailed description, taken in combination with the appended drawings, in which.

Figure 1A:
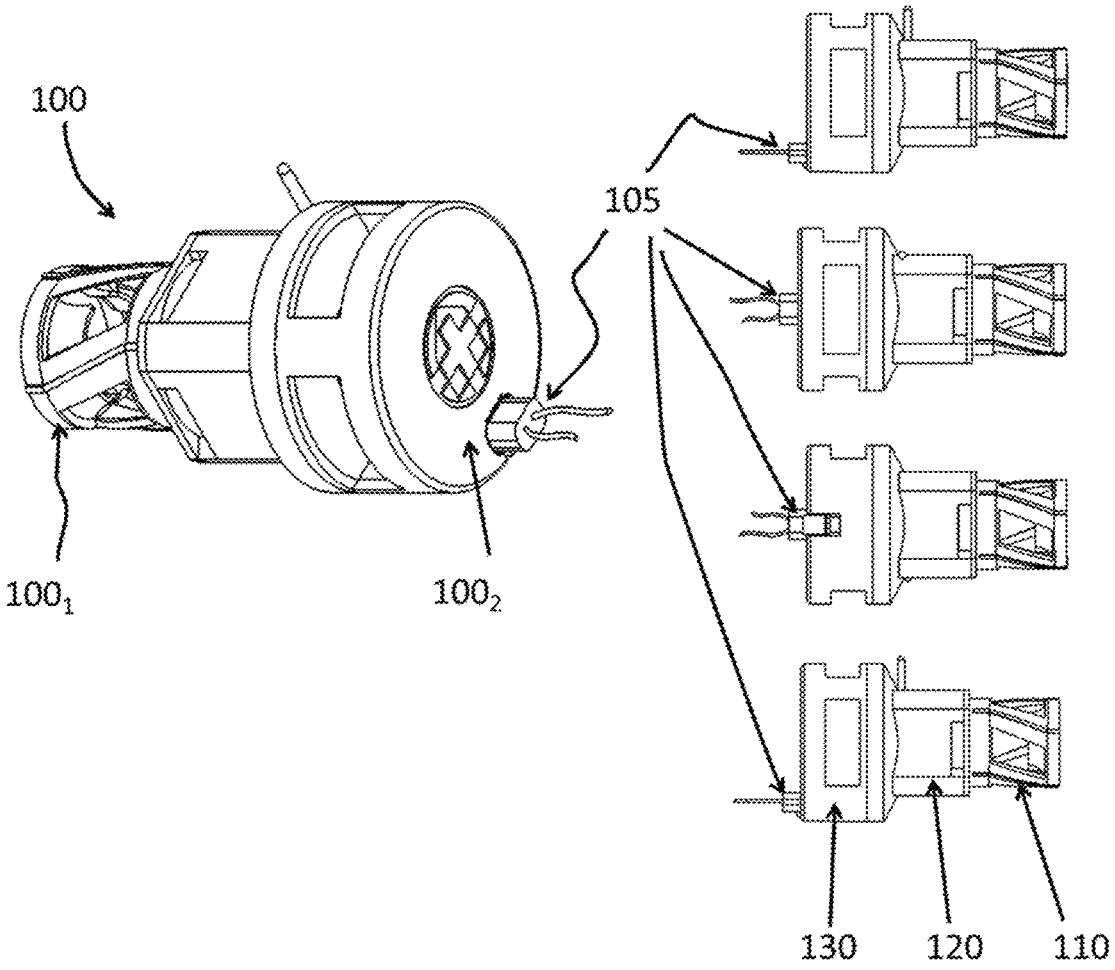
FIG. 1A shows different side elevation views of a gas injection device according to one embodiment of the present disclosure.

It is to be expressly understood that the description and drawings are only for the purpose of illustrating certain embodiments of the present disclosure and are an aid for understanding. They are not intended to be a definition of the limits of the disclosure and/or of the technology.

DETAILED DESCRIPTION OF TECHNOLOGY

The present technology is explained in greater detail below. This description is not intended to be a detailed catalog of all the different ways in which the technology may be implemented, or all the features that may be added to the instant technology. For example, features illustrated with respect to one embodiment may be incorporated into other embodiments, and features illustrated with respect to a particular embodiment may be deleted from that embodiment. In addition, numerous variations and additions to the various embodiments suggested herein will be apparent to those skilled in the art in light of the instant disclosure which do not depart from the instant technology. Hence, the following specification is intended to illustrate some particular embodiments of the technology, and not to exhaustively specify all permutations, combinations and variations thereof.

As used herein, the singular form "a," "an" and "the" include plural referents unless the context clearly dictates otherwise.

The term "about" is used herein explicitly or not, every quantity given herein is meant to refer to the actual given value, and it is also meant to refer to the approximation to such given value that would reasonably be inferred based on the ordinary skill in the art, including equivalents and approximations due to the experimental and/or measurement conditions for such given value.

The expression "and/or" where used herein is to be taken as specific disclosure of each of the two specified features or components with or without the other. For example "A and/or B" is to be taken as specific disclosure of each of (i) A, (ii) B and (iii) A and B, just as if each is set out individually herein.

In some embodiments, the present technology relates to an apparatus and control method that may be operated in different modes according to the task in hand: (a) quite mode; (b) optimized drying, and/or (c) decontamination. The approach is based on injection and/or extraction of a gas (conditioned or not) into a wall cavity through holes made for the purpose of drying and/or decontaminating materials inside cavities such as in walls, floors, ceilings, and such.

Injection/extraction is favored in order to reduce the volume of air being treated. When injecting gas into holes formed in a structure (e.g., wall) through injectors, the injectors may comprise holes themselves to promote drying of the external walls.

Most of the time, holes are cut in non-visible areas, such as behind electrical heaters, plinths and such. The holes made on the cavities are sealed after restoration following an existing procedure using dedicated wall pucks. The large dimensions of these holes (compared to systems using nozzles) are intended to increase gas flow inside the cavity.

In one embodiment, the present disclosure relates to a gas injection device for injection of gas into a wall. In some instances, the gas injection device of the present disclosure injects gas into a wall in order to dry a wall after water damages. In some instances, the gas being injected is air.

In one embodiment, the present disclosure relates to a gas extraction device for extracting a gas from a wall. In some instances, the gas extraction device of the present disclosure extracts gas from a wall in order to decontaminate a wall. In some instances, the gas being extracted is ozone, chlorine dioxide, or other.

In one embodiment, the present disclosure relates to a gas injection system using the gas injection device of the present disclosure for injecting gas into a wall.

In one embodiment, the present disclosure relates to a gas extraction system using the gas injection/extraction device of the present disclosure for extracting gas from a wall.

In one embodiment, the present disclosure relates to a gas circulating system using both the gas injection device as defined herein and the gas extraction device as defined herein to circulate gas within a wall. In some instances, the gas circulating system of the present disclosure is used to dry and to decontaminate a wall.

Although walls will be used herein to explain the present technology, it is to be appreciated that the devices and the systems of the present disclosure may also be used to dry and/or decontaminate floors and/or ceilings.

As used herein, the term "gas" refers to a state of matter wherein particles are widely separated from one another, and consequently have weaker intermolecular bonds than liquids or solids. A pure gas may be made up of individual atoms (e.g., a noble gas like neon), elemental molecules made from one type of atom (e.g., oxygen), or compound molecules made from a variety of atoms (e.g., carbon dioxide). A gas mixture would contain a variety of pure gases much like the air. As used herein, the term "air" refers to a colorless, odorless, tasteless, gaseous mixture, mainly nitrogen (approximately 78 percent) and oxygen (approximately 21 percent) with lesser amounts of argon, carbon dioxide, hydrogen, neon, helium, and other gases. In some embodiments, the gas is air. In some other instances, the gas comprises ozone ($O_3$) or chlorine dioxide ($ClO_2$). In some other instances, the gas comprises additional active agents such as hydroxyl radicals (.OH), antibiotics or antiseptic agents.

As used herein, the expression "fluid communication" refers to a flow of gas or a flow of liquid or a flow of a mixture of gas and liquid between two or more components of the device and systems as defined herein.

The gas injection/extraction device and system of the present disclosure may be portable and several units may be installed simultaneously for treatment of small or large surfaces on single or multiple rooms. The gas injection/extraction device and system of the present disclosure may be operated with minimal disturbance to room users, with reduced particle generation and limiting air movement to the inside of the wall cavity instead of moving the whole volume of air in the room as preconized by drying approaches known in the art.

In drying mode, the gas injection/extraction device and system of the present disclosure may improve drying by the use of a conditioning and distribution component combined with dehumidification and/or heating units. In decontamination mode, the gas injection/extraction device and system of the present disclosure may deliver decontamination gas inside wall cavities through a conditioning and distribution component. In some embodiments, the gas injection/extraction system of the present disclosure may include a series of sensors (sensing changes in, for example, temperature, relative humidity, material's humidity or the like) with remote monitoring and software.

In some embodiments, the gas injection/extraction device is modular, allowing to replace components thereof depending on the type of application and/or to replace used or broken parts. The gas injection/extraction device of the present disclosure may be installed on a typical wall composed of gypsum boards with mineral wool in the internal wall cavity for insolation. Alternatively, the gas injection/extraction device of the present disclosure may be installed with other structures such as solid walls.

In some embodiments, the gas injection/extraction device of the present disclosure may be used to inject pressurized air from the room to the wall cavity, floors, ceilings or other cavities in order to promote drying while reducing particle generation and noise in the room. The gas injection/extraction device may be positioned into walls, floors and/or ceilings through perforated holes. In some instances, a remote monitoring system may be used to control drying parameters during treatment.

In one embodiment, the gas injection/extraction device and system of the present disclosure produce a uniform gas flow among wall openings and adjust the gas flow independently as required.

In one embodiment, the gas injection/extraction device and system of the present disclosure integrate an air conditioning and distribution component through which conditioned air flow is provided to several ventilation modules for optimized drying.

In one embodiment, the gas injection/extraction device and system of the present disclosure integrate an air conditioning and distribution component through which a decontaminant gas such as, but not limited to, chlorine dioxide, ozone, a mix of air and vaporized hydrogen peroxide, a mix of air and hydroxyl radicals, or the like, flows through several ventilation modules for decontamination.

Additional chemicals and chemical compositions may be used to decontaminate and/or to remove contaminates trapped into wall cavities.

i) Gas Injection Module

In some embodiments, the gas injection device of the present disclosure is used to inject gas into a cavity of a wall, a floor and/or a ceiling.

Figure 1B:
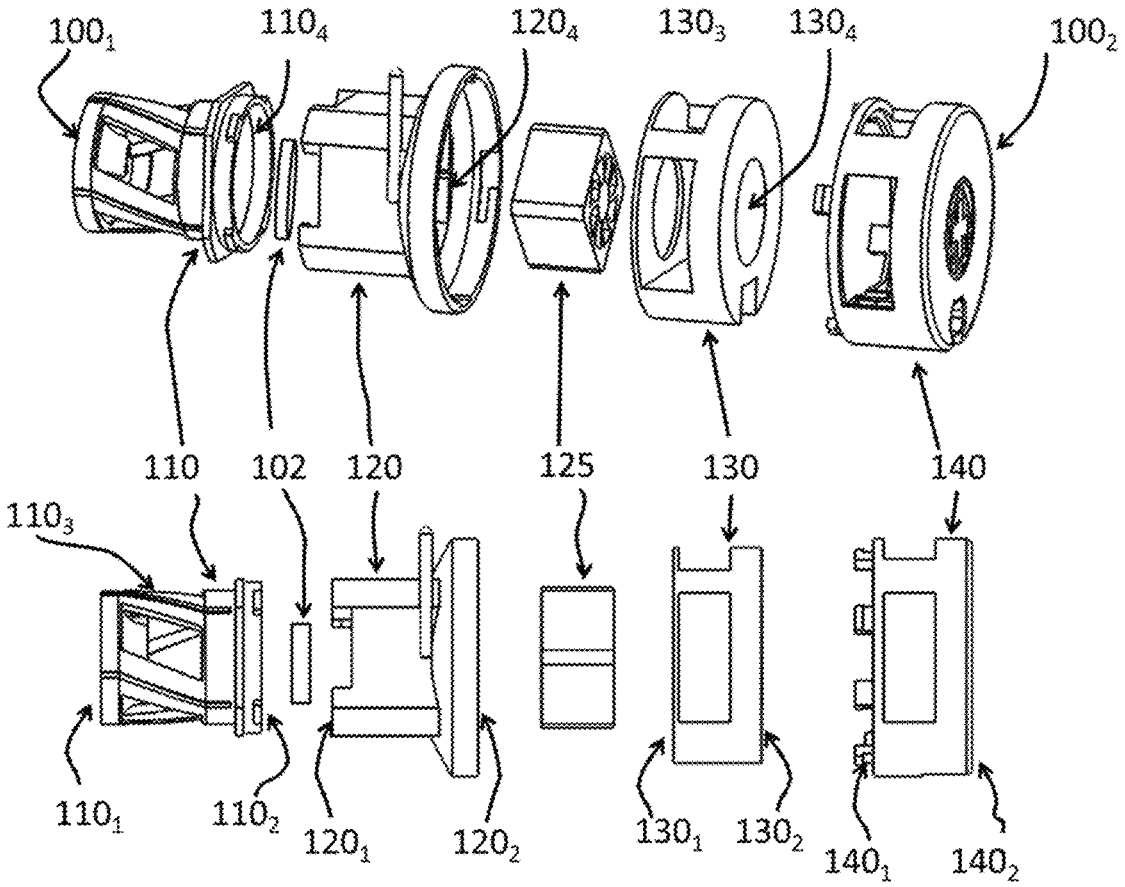
FIG. 1B shows an exploded view of the gas injection device as illustrated in FIG. 1A.

FIGS. 1A and 1B show a gas injection device according to one embodiment of the present disclosure. In this embodiment, the gas injection device (100) has a distal end ($\mathbf{100}_1$) and a proximal end ($\mathbf{100}_2$). The gas injection device (100) comprises an injector module (110), an air purification module (102), a casing module (120), a ventilation module (125) and a noise reduction module (130). In some instances, such as illustrated in FIG. 1B, the gas injection device (100) further comprises a capping module (which may be referred to as "a cap") (140).

In this embodiment, the injector module (110) is located at the distal end ($\mathbf{100}_1$) of the gas injection device (100). The injector module (110) has a distal end ($\mathbf{110}_1$), a proximal end ($\mathbf{110}_2$) and an injector wall ($\mathbf{110}_3$) joining the distal end (1100 to the proximal end ($\mathbf{110}_2$) to define an internal lumen ($\mathbf{110}_4$). The injector module (100) has a shape and size that is suitable for insertion into a hole created in a wall.

The casing module (120) has a distal end ($\mathbf{120}_1$), a proximal end ($\mathbf{120}_2$) and a casing wall ($\mathbf{120}_3$) joining the distal end ($\mathbf{120}_1$) to proximal end ($\mathbf{120}_2$) to define an internal lumen ($\mathbf{120}_4$). In this embodiment, the distal end ($\mathbf{120}_1$) of the casing module (120) is connected to the proximal end ($\mathbf{110}_2$) of the injector module (110). In some embodiments, the distal end ($\mathbf{120}_1$) of the casing module (120) is shaped so it is suitable to accept an air purification module (102). The air purification module (102) comprises an HEPA filter and/or a sanitizing tablet releasing odor control, antiseptic agents or biocides, such as chlorine, sodium hypochlorite, calcium hypochlorite, or the like.

In this embodiment, the ventilation module (125) is located into the inner lumen ($\mathbf{120}_4$) of the casing module (120). In some instances, the ventilation module (125) is a speed regulated fan. It will be appreciated that the ventilation module (125) has a shape and a size suitable for fitting into the internal lumen ($\mathbf{120}_4$).

The noise reduction module (130) has a distal end ($\mathbf{130}_1$), a proximal end ($\mathbf{130}_2$) and a noise reduction module wall ($\mathbf{130}_3$) joining the distal end ($\mathbf{130}_1$) to the proximal end ($\mathbf{130}_2$); the noise reduction module wall ($\mathbf{130}_3$) defining an internal lumen ($\mathbf{130}_4$). In this embodiment, the distal end ($\mathbf{130}_1$) of the noise reduction module (130) is connected to the proximal end ($\mathbf{120}_2$) of the casing module (120).

The capping module (140) has a distal end ($\mathbf{140}_1$), a proximal end ($\mathbf{140}_2$) and a capping wall ($\mathbf{140}_3$) joining the distal end ($\mathbf{140}_1$) to the proximal end ($\mathbf{140}_2$); the capping wall ($\mathbf{140}_3$) defining an internal lumen ($\mathbf{140}_4$). In some instances, the capping module is an air inlet cap. In this embodiment, the distal end ($\mathbf{140}_1$) of the capping module (140) is connected to the proximal end ($\mathbf{120}_2$) of the casing module (120).

Figure 2A:
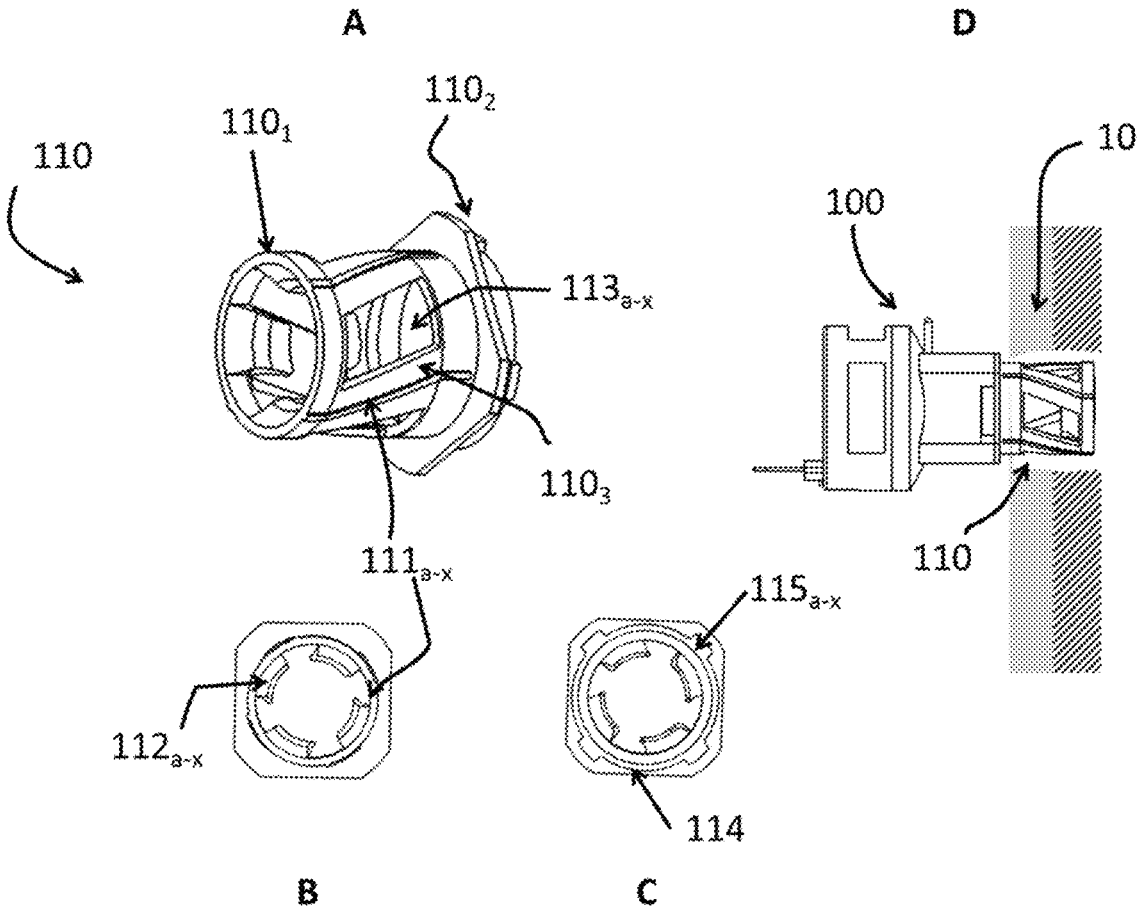
FIG. 2A shows side elevation view (A), front views (B, C) and in-use (e.g., inserted into a wall cavity) view (D) of the gas injection device as illustrated in FIG. 1A.

As best seen in FIG. 2A, the proximal end ($\mathbf{110}_2$) of the injector module (110) comprises an injector-to-casing connector (114) for connection with the casing module (120). The injector-to-casing connector (114) comprises a twist-fit male connecting system comprising a plurality of connections means (e.g., male mold locks) ($\mathbf{115}_{a\text{-}x}$) for connecting and in some instances locking to the casing module (120). The injector-to-casing connector (114) may vary in number and shape to allow rapid and firm injector assembly. Alternatively, the injector-to-casing connector (114) may comprise an internal screw thread to be screwed to an external screw thread on the proximal end ($\mathbf{120}_2$) of the casing module (120).

The injection module (110) also comprises a plurality of attachment means ($\mathbf{111}_{a\text{-}x}$) located along the injector wall ($\mathbf{110}_3$) that allow inserting and fitting the injection module (110) into a wall cavity (10). In this embodiment, the attachment means ($\mathbf{111}_{a\text{-}x}$) are protrusions extending from the outside surface of the injector wall ($\mathbf{110}_3$). A plurality of flaps ($\mathbf{112}_{a\text{-}x}$) is distributed along the internal surface of the injector wall ($\mathbf{110}_3$) to promote air flow into the wall cavity (10). The plurality of flaps ($\mathbf{112}_{a\text{-}x}$) comprising a plurality of inlets ($\mathbf{113}_{a\text{-}x}$) to lead air flow into a preferential direction into the wall cavity (10). In this embodiment, the injector wall ($\mathbf{110}_3$) follows a diagonal from the proximal end ($\mathbf{110}_2$) to the distal end ($\mathbf{110}_1$) with a particular angle (e.g. 30°) as depicted in FIG. 2A.

Figure 2B:
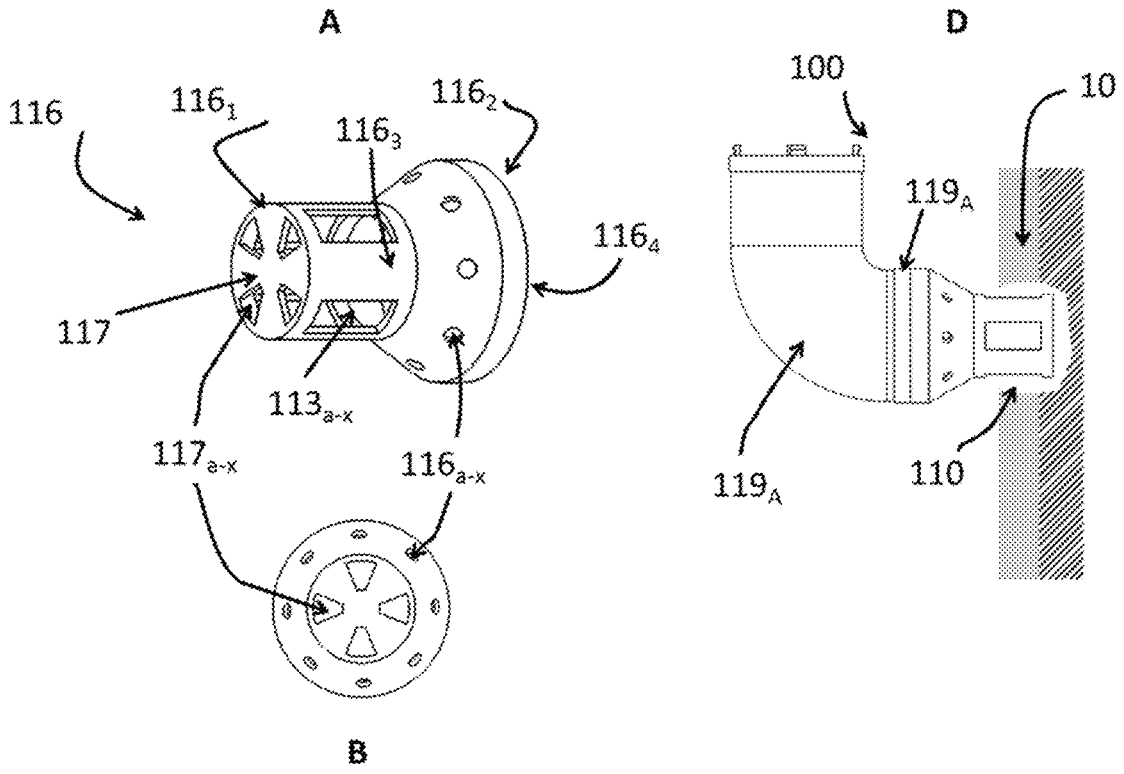
FIG. 2B show side elevation view (A), front view (B) and in-use (e.g., inserted into a wall cavity) view (D) of a gas injection device according to another embodiment of the present disclosure.

Another embodiment of the injector module is depicted in FIG. 2B, wherein the injector module (116) has a distal end ($\mathbf{116}_1$), a proximal end ($\mathbf{116}_2$) and an injector wall ($\mathbf{116}_3$) joining the distal end ($\mathbf{116}_1$) to the proximal end ($\mathbf{116}_2$) to define an internal lumen ($\mathbf{116}_4$). In this embodiment, the injector wall ($\mathbf{116}_3$) extends perpendicularly from the proximal end ($\mathbf{116}_2$) and the distal end ($\mathbf{116}_1$) as depicted in FIG. 2B. In this embodiment, the distal end ($\mathbf{116}_1$) of the injector module (116) is closed by a distal end wall (117) having a plurality of distal end openings ($\mathbf{117}_{a\text{-}x}$) (e.g., 4), wherein each one of the distal end openings ($\mathbf{117}_{a\text{-}x}$) is aligned with an inlet (113) in the plurality of inlets ($\mathbf{113}_{a\text{-}x}$).

The injector module (116) also comprises a plurality of ventilation openings ($\mathbf{116}_{a\text{-}x}$) along the injector wall ($\mathbf{116}_3$) through which air flows in direction to the external part of the wall (10) to improve drying. The shape and number of ventilation openings ($\mathbf{116}_{a\text{-}x}$) varies according to the targeted application. In the embodiment depicted in FIG. 2B, the injector module (116) comprises 8 ventilation openings ($116_{a-f}$) oriented at about 45° with respect to the external wall. It is to be understood that the ventilation openings ($116_{a-x}$) may be oriented at different angles without departing from the present technology.

Figure 2C:
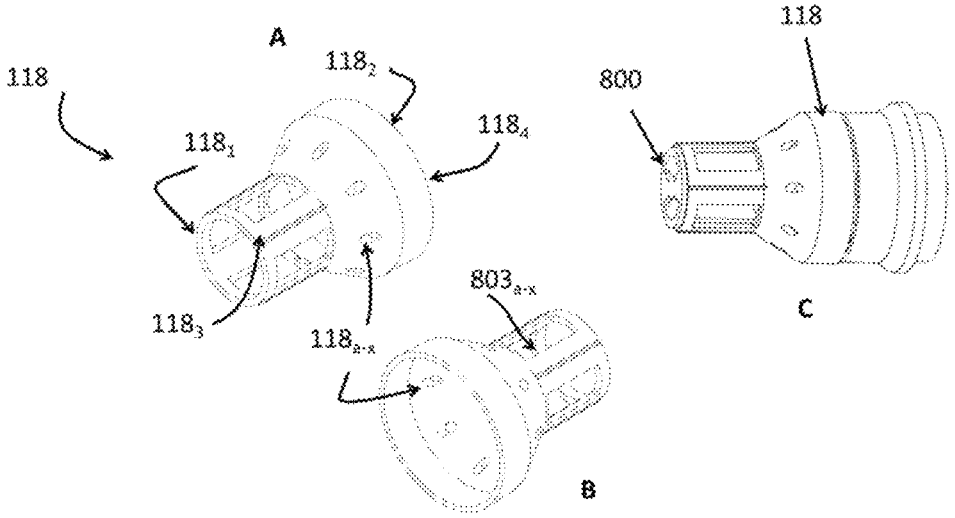
FIG. 2C show side elevations views (A, B), and side elevation view of the injector-deviator assembly (C) to another embodiment of the present disclosure.

In yet another embodiment, the injector module is depicted in FIG. 2C, wherein the injector module (118) has a distal end ($118_1$), a proximal end ($118_2$) and an injector wall ($118_3$) joining the distal end ($118_1$) to the proximal end ($118_2$) to define an internal lumen ($118_4$). In this embodiment, the injector wall ($118_3$) extends perpendicularly from the proximal end ($118_2$) and the distal end ($118_1$) as depicted in FIG. 2C. The injector module (118) also comprises a plurality of ventilation openings ($118_{a-x}$) along the injector wall ($118_3$) through which air flows in direction to the external part of the wall (10) to improve drying. The shape and number of ventilation openings ($118_{a-x}$) varies according to the targeted application. In the embodiment depicted in FIG. 2C, the injector module (118) comprises 8 ventilation openings ($118_{a-f}$) oriented at about 45° with respect to the external wall. It is to be understood that the ventilation openings ($118_{a-x}$) may be oriented at different angles without departing from the present technology. In this embodiment, the distal end ($118_1$) of the injector module (118) has a plurality of inlets ($803_{a-x}$) (e.g., 4). The internal lumen ($118_4$) of the injector module (118) is adapted to receive the directional mobile deviator (800) as will now be discussed.

Figure 2D:
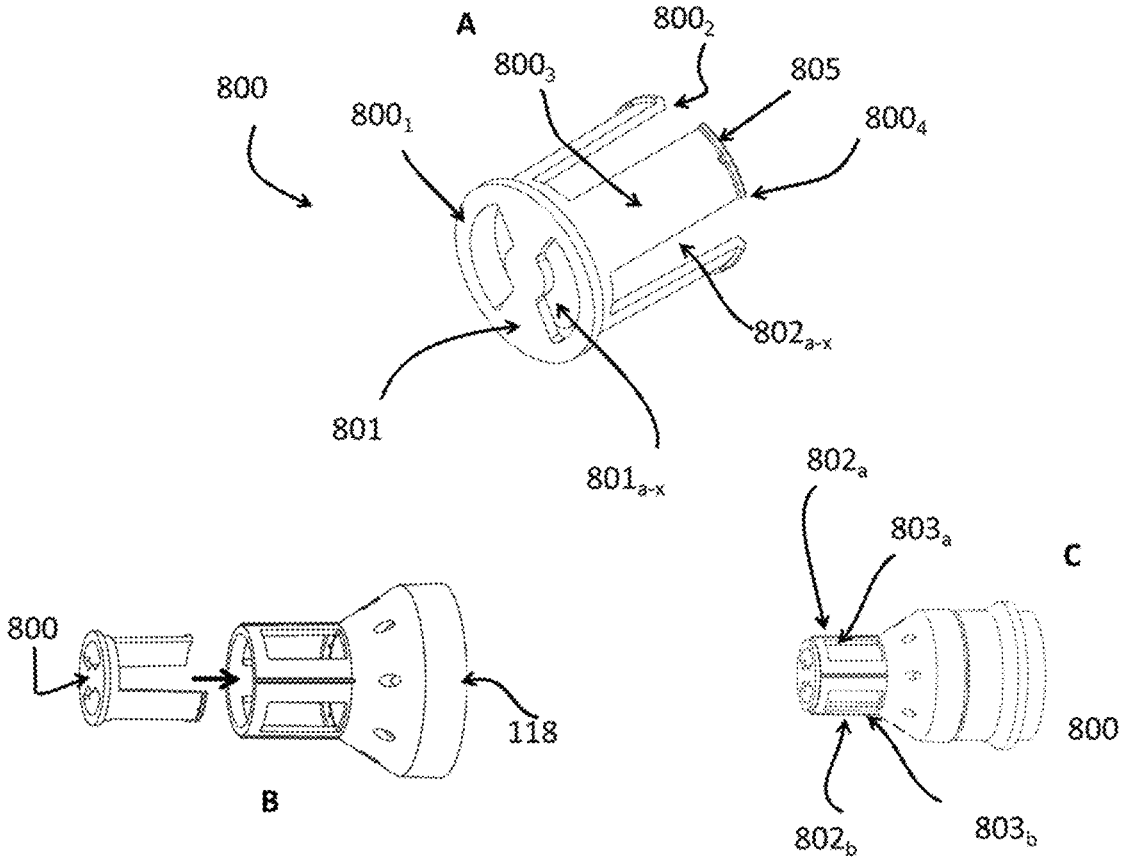
FIG. 2D show side elevation view (A) of the deviator, and side elevation views of the injector-deviator assembly (B, C).

In some embodiments, the injector module (118) comprises an adjustable directional flow deviator (800), as best seen in FIG. 2D. The directional flow deviator (800) has a distal end ($800_1$), a proximal end ($800_2$) and an injector wall ($800_3$) joining the distal end ($800_1$) to the proximal end ($800_2$) to define an internal lumen ($800_4$). The distal end ($800_1$) of the directional flow deviator (800) is closed by a distal end wall (801) having a plurality of distal end openings ($801_{a-x}$) (e.g., 2), wherein each one of the distal end openings ($801_{a-x}$) may or may not be aligned with a plurality of inlets ($802_{a-x}$). The plurality of inlets ($802_{a-x}$) are irregularly spaced to be totally, partially or not aligned to the plurality of inlets ($803_{a-x}$) of the injector module (118) in order to totally or partially allow or completely impede gas flow through one or more of the plurality of distal end openings ($801_{a-x}$) depending on the preferred direction of the gas flow. In the embodiment in FIGS. 2C and 2D, the directional flow deviator (800) is positioned in the injector module (118) as to allow gas flow circulation through one injector module opening ($803_a$) and to impede gas flow through the other three injector module openings ($803_{b-d}$). In this embodiment, the injector wall ($118_3$) and the directional mobile deviator wall ($800_3$) are aligned longitudinally so that their respective proximal ends ($118_2$ and $800_2$) and respective distal ends ($118_1$ and $800_1$) coincide such as seen in FIG. 2D. In some implementations of these embodiments, the directional flow deviator (800) is made of resilient material which allows the directional flow deviator (800) to adjust to the internal lumen ($118_4$) of the injector module (118) when being inserted therein.

Figure 3:
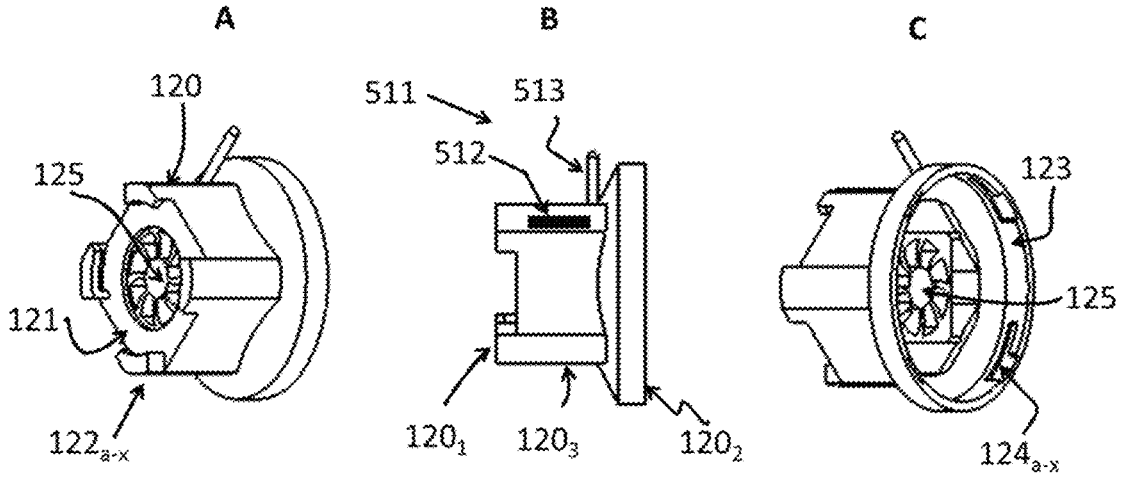
FIG. 3 shows a side elevation view of a first side (A), a side view (B) and a side elevation view of another side (C) of a fan casing according to one embodiment of the present disclosure.

In some instances, the directional mobile deviator (800) locks into the injector module (118) through clapping system at the proximal ($800_2$) end of the injector wall ($800_3$) allowing the deviator to rotate into the preferred position. The locking systems is semi-tightly fixed into the selected position in such a way that is not affected by gas circulation but is still possible to rotate by hand to another position if require. FIG. 3 shows an embodiment of the casing module (120) according to the present disclosure into which the ventilation module (125) has been inserted. The distal end ($120_1$) of the casing module (120) comprises a casing-to-injector connector (121) for connecting the casing module (120) to the injector module (110). In this embodiment, the casing-to-injector connector (121) comprises a twist-fit female connecting system comprising a plurality of connections means (e.g., female mold locks) ($122_{a-x}$) for connection and in some instances locking with the plurality of attachment means ($115_{a-x}$) of the injector module (110). The proximal end ($120_2$) of the casing module (120) comprises a casing-to-capping connector (123) for connection with the capping module (140). The casing-to-capping connector (123) comprises one or more twist-fit female connecting system ($124_{a-x}$), which receives the twist-fit male connecting system ($141/142_{a-x}$) of the capping module (140). Alternatively, the casing-to-capping connector (123) may involve an internal screw thread, which receives an external screw thread of the locking system of the capping module (140).

In some embodiments, as seen in FIG. 3, the casing module (120) comprises a wireless communication system (511) for communication with a control and monitoring system which will be discussed in greater lengths below. In some instances, the wireless communication system (511) of the casing module (511) comprises a wireless an electronic circuit board (512) and an antenna (513) to establish communication with the control and monitoring system (not shown).

In this embodiment, the internal lumen ($120_4$) of the casing module (120) has a shape suitable to accept the ventilation module (125) so that the entirety of the ventilation module (125) fits into the lumen ($120_4$) of the casing module (120). The ventilation module (125) may be placed into the internal lumen ($120_4$) of the casing module (120) through the proximal end ($120_2$) opening of the casing (120). In some instances, the inner lumen ($120_4$) of the casing module (120) and/or the exterior surface of the ventilation module (125) may comprise attachments means to firmly attach the ventilation system (125) into the inner lumen ($120_4$) of the casing module (120).

The ventilation system (125) may be adjusted to the desired speed by regulating the voltage furnished by a power supply (400). In some instances, the ventilation system (125) is a 40×40×28 mm fan (model: PF40281B1-000U-A99 from Sunon® (Kaohsiung, Taiwan)) having a motor of 6 W (12V, 510 mA).

Figure 4:
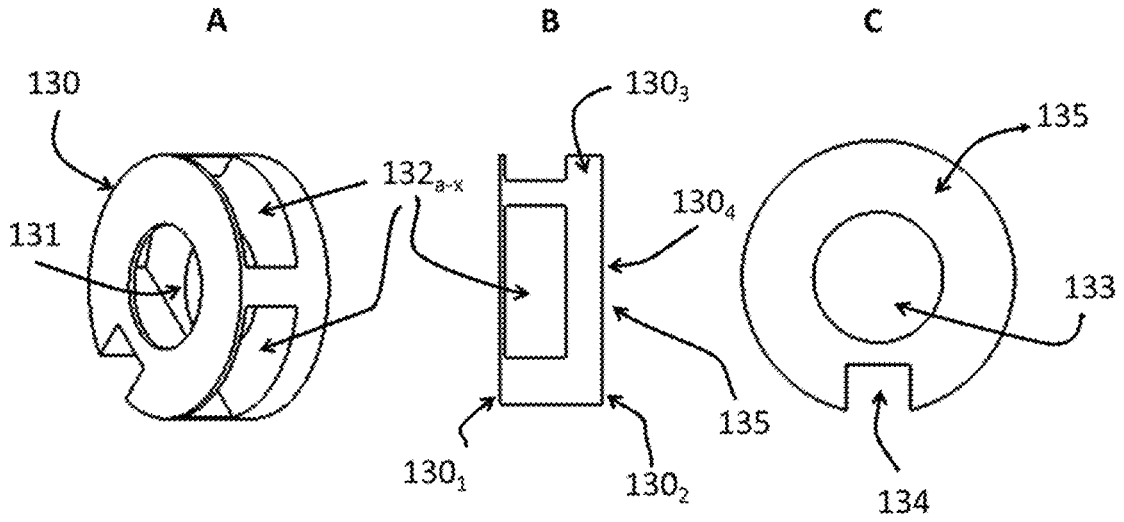
FIG. 4 shows a side elevation view of a first side (A), a side view (B) and a side elevation view of another side (C) of a noise reduction system according to one embodiment of the present disclosure.

In some embodiments, the gas injection device (100) comprises a noise reduction module (130) which is best illustrated in FIG. 4. The noise reduction module (130) has a distal end ($130_1$), a proximal end ($130_2$) and a noise reduction module wall ($130_3$) joining the distal end ($130_1$) to the proximal end ($130_2$) and defining an internal lumen ($130_4$). The internal lumen ($130_4$) defines a channel (131) through which the gas flows. The distal end ($130_1$) of the noise reduction module (130) comprises a distal surface (131) disposed on the distal periphery of the noise reduction module wall ($130_3$), thereby partially closing the distal end ($130_1$) of the noise reduction system (130). The proximal end ($130_2$) of the noise reduction module (130) comprises a proximal surface (135) disposed on the proximal periphery of the noise reduction module wall ($130_3$), thereby partially closing the proximal end ($130_2$).

The noise reduction module (130) comprises a plurality of lateral air inlets ($132_{a-x}$) and a second axial channel inlet (133) to allow air flow into the noise reduction module (130) from the capping module (140). In the embodiment depicted in FIG. 4, the noise reduction module (130) comprises three (3) lateral inlets ($132_{a-x}$) with rectangular shape to register with the air inlets ($143_{a-x}$, FIG. 5) along the wall of the capping module (140) having a similar size and shape. It will be appreciated that the noise reduction module (130) may comprise fewer or additional lateral inlets ($\mathbf{132}_{a\text{-}x}$) without departing from the present technology. In some embodiments, the noise reduction module (130) comprises an opening (134) on the periphery of the proximal surface (135) for accepting the electrical plug (105) (see FIG. 1A).

Figure 5:
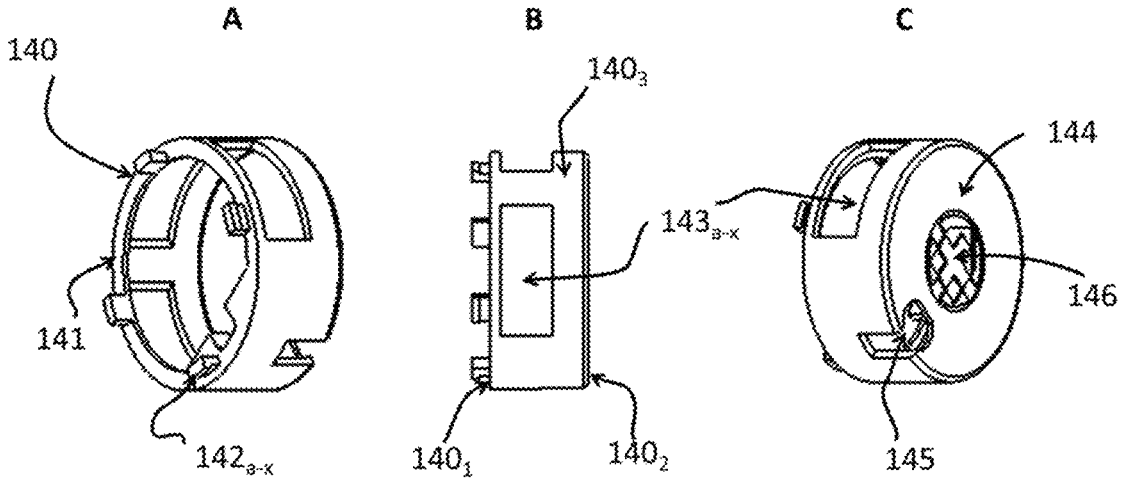
FIG. 5 shows a side elevation view of a first side (A), a side view (B) and a side elevation view of another side (C) of an air inlet quiet mode closing cap according to one embodiment of the present disclosure.

The capping module (140) is illustrated in greater details in FIG. 5. The capping module (140) has a distal end ($\mathbf{140}_1$), a proximal end ($\mathbf{140}_2$) and a capping wall ($\mathbf{140}_3$) joining the distal end ($\mathbf{140}_1$) to the proximal end ($\mathbf{140}_2$) defining an internal lumen ($\mathbf{140}_4$). The distal end ($\mathbf{140}_1$) of the capping module (140) comprises a capping-to-casing connector (141) for connection of the capping module (140) with the casing module (120). The capping-to-casing connector (141) comprises a twist-fit male connecting system module comprising a plurality of connections means (male mold locks) ($\mathbf{142}_{a\text{-}x}$) for connection and in some instances locking with the casing-to-injector connector (121) of the casing module (120). The proximal end ($\mathbf{140}_2$) of the capping module (140) comprises a proximal surface (144) disposed on the proximal periphery of the capping wall ($\mathbf{140}_3$), thereby closing the proximal end ($\mathbf{140}_2$) of the capping module (140). The proximal end ($\mathbf{140}_2$) of the capping module (140) comprises an electrical plug opening (145) for accepting an electrical plug (105) (see FIG. 1A). In some instances, the proximal surface (144) of the capping module (140) may comprise a light source (146) for allowing visual monitoring.

In some embodiments, the injector module (110), the casing module (120), the noise reduction module (130) and the capping module (140) have a substantially cylindrical shape. It will be appreciated that the injector module (110), the casing module (120), the noise reduction module (130) and the capping module (140) may be of another shape without departing from the present technology.

In some embodiments, the injector module (110), the casing module (120), the noise reduction module (130) and the capping module (140) are made from the same material. Examples of materials from which the modules of the gas injection device (100) may be made include, but are not limited to, reinforced resins such as, but not limited to, polycarbonate (PC), polyvinylchloride (PVC), thermoplastic polyurethane (TPU) etc. or a combination of such. In some instances, the internal and/or external surfaces are covered by an antimicrobial coating such as Parylene™. In some other embodiments, each of the modules of the gas injection device (100) is made from a different material. The materials that may be used to make the components of the gas injection device (100) will be apparent to the person skilled in the art.

In some embodiments, the gas injection device of the present disclosure is composed of the injector module (116) as depicted in FIG. 2B. In this embodiment, a ventilation module (e.g., element (125) of FIG. 1B) is not required and the ventilation functions are accomplished by the ventilations openings ($\mathbf{116}_{a\text{-}x}$) on the injector wall ($\mathbf{116}_3$) and/or the distal end openings ($\mathbf{117}_{a\text{-}x}$) on the distal end wall (117). In some instances, the injector module (116) may be connected to an injection duct ($\mathbf{119}_A$) through an injector-to-duct connector ($\mathbf{119}_B$). In this embodiment, the ventilation openings ($\mathbf{116}_{a\text{-}x}$) are oriented to direct air flow to the external surface of the wall, the air being propelled by a conditioning unit and flowing through the inner lumen ($\mathbf{116}_4$) of the injector module (116).

ii) Gas Extraction Module

In some embodiments, the gas injection device of the present disclosure may be used to extract gas from a cavity of a wall, a floor and/or a ceiling. In such embodiments, the gas injection device may be referred to as a gas extraction device. In some instances, the gas extraction device comprises the same components as the gas injection device however, instead of injecting gas into a cavity of a wall (e.g., gas flowing from the noise reduction module, through the casing module/ventilation system and through the injection module and injected into the cavity of the wall), the gas extraction device extracts a gas from a cavity of a wall. In these embodiments, the gas is extracted from the cavity of the wall into the injector module which then becomes an extractor module, through the casing module and then through the noise reduction module.

In some instances, the ventilation module for extraction mode is installed on a reverse position with respect to the injection mode in order to extract air from the cavity of a wall and force it into the gas extraction system. In some other instances, the ventilation module comprises a mechanism allowing to invert the direction of the gas flow.

In some embodiments, the gas ejection device of the present disclosure is composed of the ejector module (116) as depicted in FIG. 2B. In this embodiment, a ventilation module (e.g., element (125) of FIG. 1B) is not required and the ventilation functions are accomplished by the ventilations openings ($\mathbf{116}_{a\text{-}x}$) on the ejector wall ($\mathbf{116}_3$) and/or the distal end openings ($\mathbf{117}_{a\text{-}x}$) on the distal end wall (117). In some instances, the ejector module (116) may be connected to an ejector duct ($\mathbf{119}_A$) through an ejector-to-duct connector ($\mathbf{119}_B$). In this embodiment, the ventilation openings ($\mathbf{116}_{a\text{-}x}$) are oriented to direct air flow to the external surface of the wall.

iii) Assembly of Gas Injection/Extraction Modules

As best seen in FIG. 1B, the gas injection device (100) of the present disclosure may be assembled by first connecting the injector module (110) to the casing module (120) via the injector-to-casing connector (114) and the casing-to-injector connector (121). The ventilation module (125) is then inserted into the casing module (120) followed by insertion of the noise reduction module (130). The capping module (140) is then connected to the casing module (120) via the capping-to-casing connector (141) and the casing-to-injector connector (121).

In some embodiments, the noise reduction module (130) has a shape and size that allows it to fit entirely into the inner lumen ($\mathbf{140}_4$) of a capping module (140).

Once assembled, the inner lumen ($\mathbf{110}_4$) of the injector module (110), the inner lumen ($\mathbf{120}_4$) of the casing module (120), the inner lumen ($\mathbf{130}_4$) of the noise reduction module (130) and the inner lumen ($\mathbf{140}_4$) of the capping module (140) are in registration and/or aligned so as to form a passageway allowing a gas (e.g., air) to flow from the noise reduction module (130), through the ventilation module (125), through the casing module (120) and through the injector module (110). In the instances where the gas injection device (100) is inserted into a wall, the gas (e.g., air) coming out of the injector module (110) is directed into the wall.

The capping module (140) may be used with the gas injection device (100) of the present disclosure when the gas injection device (100) is not connected to a gas injection system of the present disclosure as will be discussed below.

It will be appreciated that the ways of assembling the gas injection device of the present disclosure are also applicable to the assembly of the gas injection device when it is used as a gas extraction device. In such instances, the ventilation module (125) is inserted into the casing module (120) on an inverted direction with respect to the position used in injection mode, or the ventilation module (125) used is capable to invert the direction of the gas flow.

iv) Gas Injection/Extraction

In some embodiments, the gas injection device of the present disclosure may be part of a gas injection system.

Figure 6A:
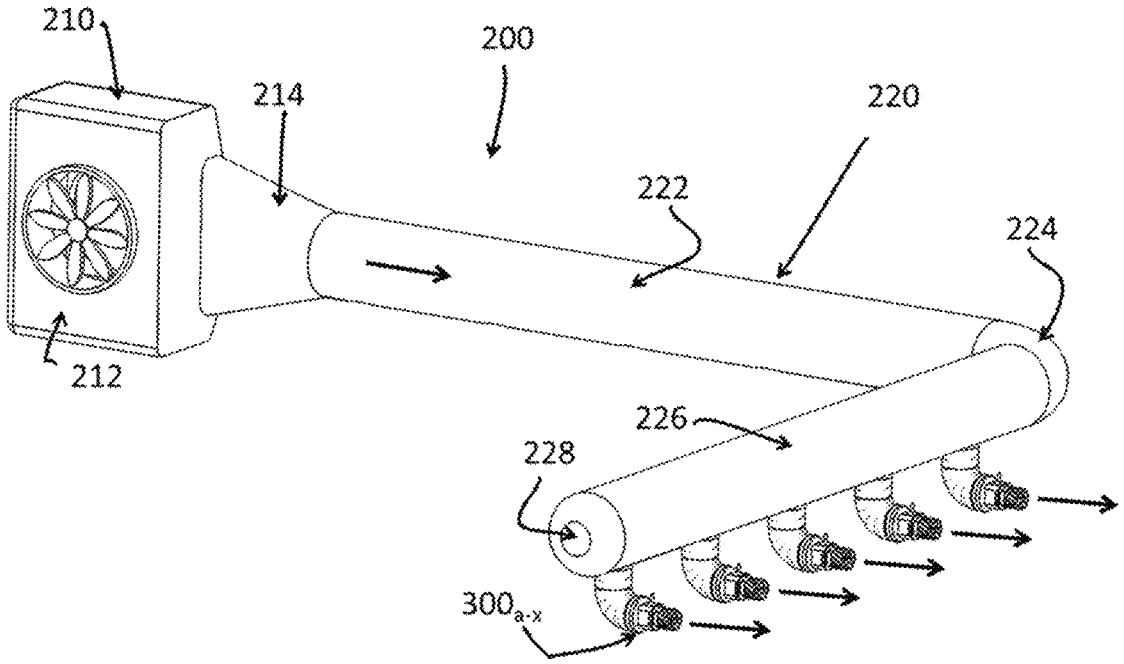
FIG. 6A shows a schematic representation of an air/gas distribution system according to one embodiment of the present disclosure comprising the gas injection device as illustrated in FIG. 2A.
Figure 6B:
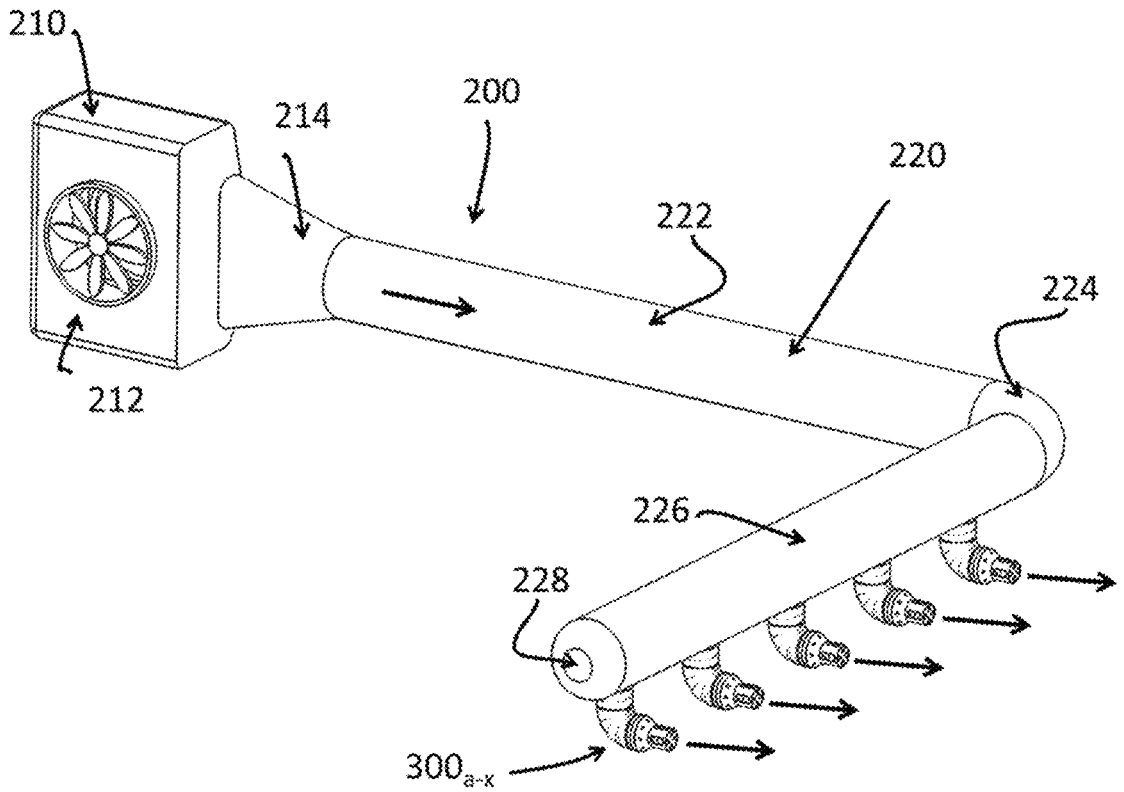
FIG. 6B shows a schematic representation of an air/gas distribution system according to another embodiment of the present disclosure comprising the gas injection device as illustrated in FIG. 2B.

FIG. 6A illustrates an embodiment of a gas injection system of the present disclosure. In this embodiment, the gas injection system (200) comprises a drying module (210), a distribution unit (220) and a plurality of gas injection devices ($\mathbf{300}_{a\text{-}x}$). The drying module (210) comprises a conditioning unit (212) and an inlet adaptor (214) connecting the conditioning unit (212) to the distribution unit (220). FIG. 6B illustrates another embodiment of a gas injection system of the present disclosure. In this embodiment, the gas injection system (200) comprises a drying module (210), a distribution unit (220) and a plurality of gas injection devices ($\mathbf{300}_{a\text{-}x}$) wherein the plurality of gas injection devices ($\mathbf{300}_{a\text{-}x}$) comprise injection modules having a plurality of ventilation openings as also seen in FIG. 2B.

Figure 7:
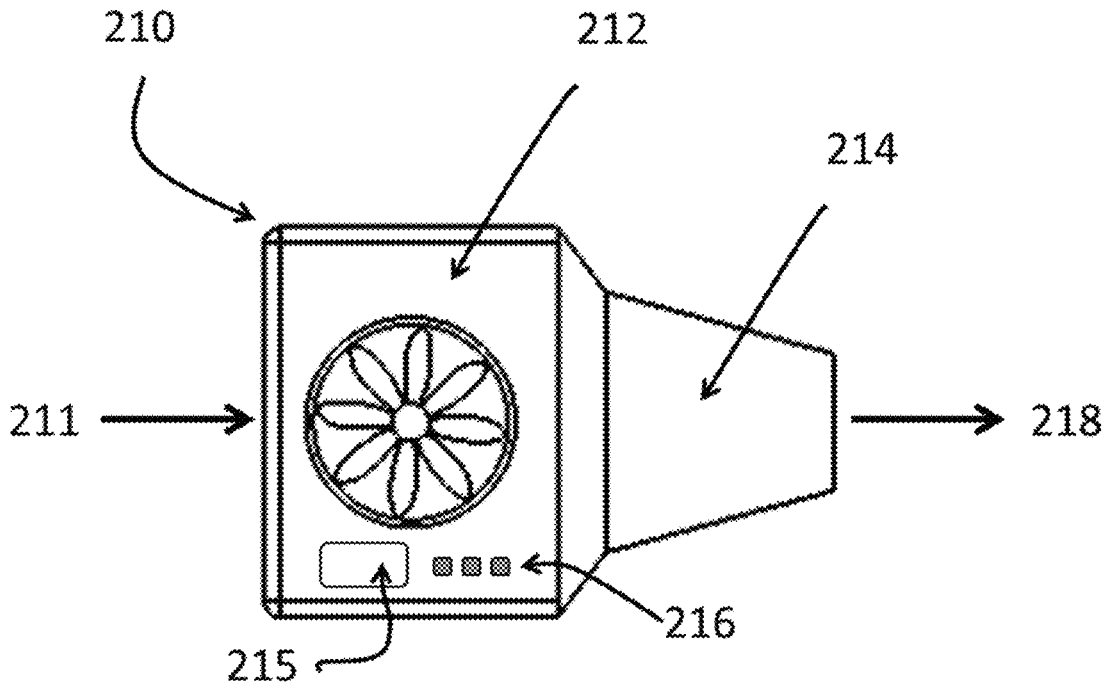
FIG. 7 shows a side view of an air conditioning unit according to one embodiment of the present disclosure.

An example of drying module (210) is illustrated in FIG. 7, wherein the conditioning unit (212) comprises an inlet (211) and a conditioned gas outlet (218), as well as optional features such as, but not limited to, a monitoring screen (215) and a heating and dehumidification control (216). The heating and dehumidification control (216) allows to control the output of the conditioning unit (212) and to visualize the setting on the monitoring screen (215). The arrow represents the flow of gas entering the conditioning unit (212) through the inlet (211) and exiting the conditioning unit (212) through the outlet (218).

The distribution system (220) comprises a combination of one or more components, such as for example, but not limited to: one or more continuous tube (222) through which gas flows without possibility of exiting the tube (e.g., without injection outlets), one or more elbow sections (224) having different angles allowing to circumvent possible obstacles or to follow changes in surface direction; one or more injection tubing sections (226) having one or more injection outlets ($\mathbf{230}_{a}$ best seen in FIG. 8A); and a stopper (228) to close the distribution unit (220). In some instances, the one or more injection outlets ($\mathbf{230}_{a\text{-}x}$) are holes made in the tubing section (226) to connect the injection devices of the present disclosure.

In some embodiments, the one or more components of the distribution system (220) such as the continuous tube (222), the elbow sections (224), the injection tubing section (226) and the stoppers (228) are made from flexible resin materials such as polyethylene that can be installed and modified in situ and can be detached to be disposed after intervention to avoid the risk of cross-contamination. In another embodiment, the components of the distribution system are made of polystyrene fabric or other air tight material. Elbow sections (224) can be custom made for particular angles or fabricated in situ using a belt-loop and strap system.

Figure 8:
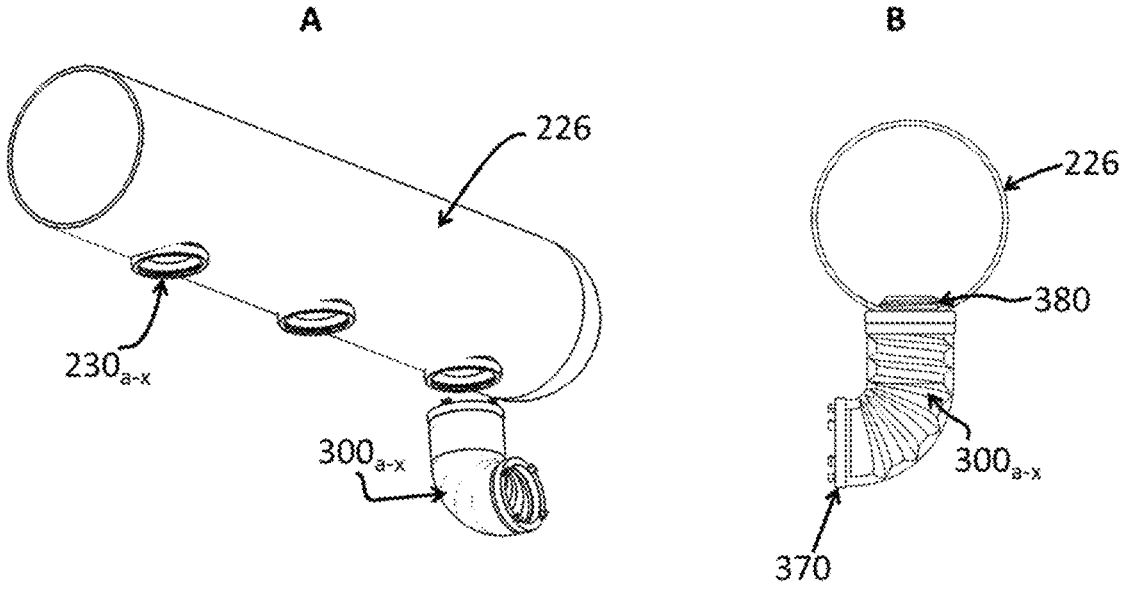
FIG. 8 shows an exploded view (A) and a lateral cross-sectional view (B) of a gas injection/extraction device as connected to outlets of an injection tube according to one embodiment of the present disclosure.

In this embodiment, the injection tubing section (226) has a plurality of injection outlets ($\mathbf{230}_{a\text{-}x}$) (in this instance the injection outlets are holes). The plurality of injection outlets ($\mathbf{230}_{a\text{-}x}$) are in connection with a plurality of gas injection devices ($\mathbf{300}_{a\text{-}x}$), wherein each outlet in the plurality of injection outlets ($\mathbf{230}_{a\text{-}x}$) is connected to one gas injection device in the plurality of gas injection devices ($\mathbf{300}_{a\text{-}x}$) as depicted in FIG. 8A. The arrow (FIGS. 6A and 6B) represents the flow of gas from the drying module (210) through the distribution unit (220) out the gas injection devices ($\mathbf{300}_{a\text{-}x}$) and into cavities in a wall (not shown).

Figure 9A:
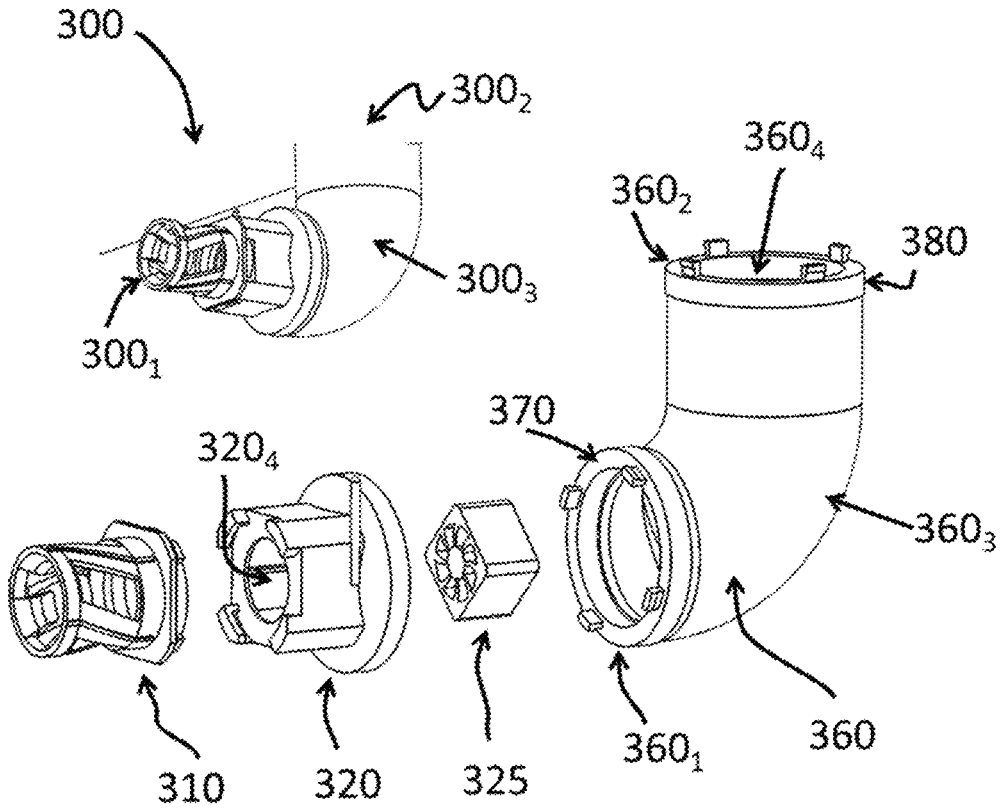
FIG. 9A shows an exploded view of a gas injection/extraction device according to one embodiment of the present disclosure comprising the gas injection device illustrated in FIG. 2A.

As shown in FIG. 9A, the gas injection device (300) of the gas injection system (200) has a distal end ($\mathbf{300}_1$) and a proximal end ($\mathbf{300}_2$) and comprises an injector module (310), a casing module (320), a ventilation module (325) and an injection duct (360). In this embodiment, the ventilation module (325) is placed into the inner lumen ($\mathbf{320}_4$) of the casing module (320). The casing module (320) is connected to the injector module (310) and the injection duct (360) is connected to the casing module (320).

Figure 9B:
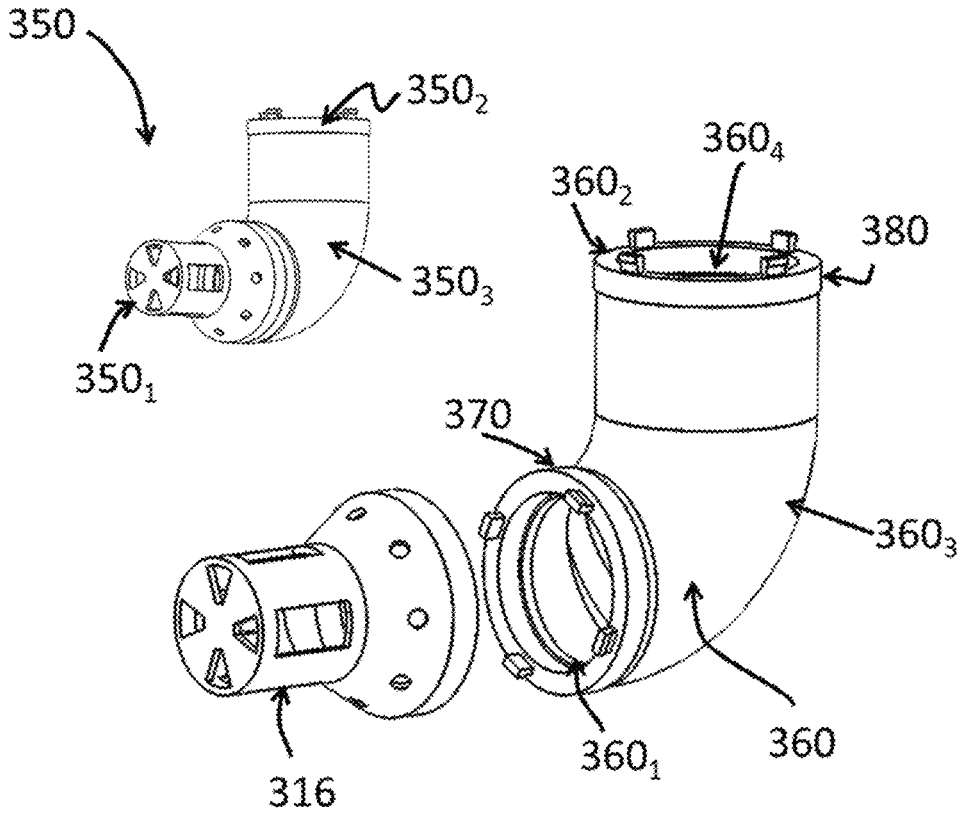
FIG. 9B shows an exploded view of a gas injection/extraction device according to one embodiment of the present disclosure comprising the gas injection device illustrated in FIG. 2B.

In another embodiment of the gas injection system (200), when optimized drying is to be privileged over noise reduction mode, the gas injection module (300) may be used without a ventilation module (325), gas flow being assured by the drying module (210) operating at high gas velocity. The gas injection system (200) and the gas injection module (300) for such embodiment are depicted in FIG. 6B and FIG. 9B, respectively. The injection duct (360) has a distal end ($\mathbf{360}_1$), a proximal end ($\mathbf{360}_2$) and an injector wall ($\mathbf{360}_3$) joining the distal end ($\mathbf{360}_1$) to proximal end ($\mathbf{360}_2$); the injector wall ($\mathbf{360}_3$) defining an internal lumen ($\mathbf{360}_4$). In one embodiment, the injector wall ($\mathbf{360}_3$) comprises a retractable duct made of synthetic materials such as, for example, but not limited to, PVC, as depicted in FIG. 8B. In another embodiment, the injector, the injector (316), similar to the connector module (116) in FIG. 2B, comprises a plurality of distal end openings to promote drying on the external surface of the cavity being treated.

Figure 10:
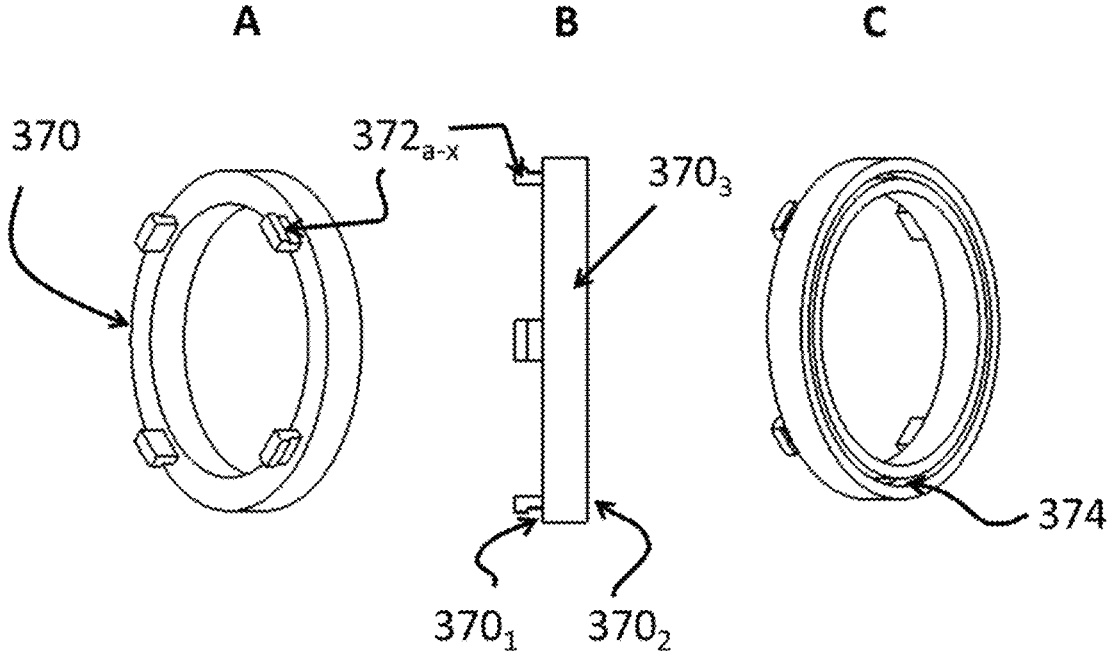
FIG. 10 shows a side elevation view of a first side (A), a side view (B) and a side elevation view of another side (C) of an injector connection module according to one embodiment of the present disclosure.

The distal end ($\mathbf{360}_1$) comprises a duct-to-casing connector (370) as illustrated in greater details in FIG. 10. The duct-to-casing connector (370) has a distal end ($\mathbf{370}_1$), a proximal end ($\mathbf{370}_2$), a connector wall ($\mathbf{370}_3$) joining the distal end ($\mathbf{370}_1$) to the proximal end ($\mathbf{370}_2$) to define an internal lumen ($\mathbf{370}_4$). The distal end ($\mathbf{370}_1$) comprises one or more locking elements ($\mathbf{372}_{a\text{-}x}$), in particular male connectors to connect the injection duct (360) to the casing module (320), the injector (110, 116, or 118) or to a duct-to-injection outlet connector (380) seen in FIG. 11A (described below). The proximal end ($\mathbf{370}_2$) of the duct-to-casing connector (370) is shaped into an indentation connection system (374) suitable for connection or in some instance locking with the injection wall ($\mathbf{360}_3$) of the injection duct (360).

Figure 11A:
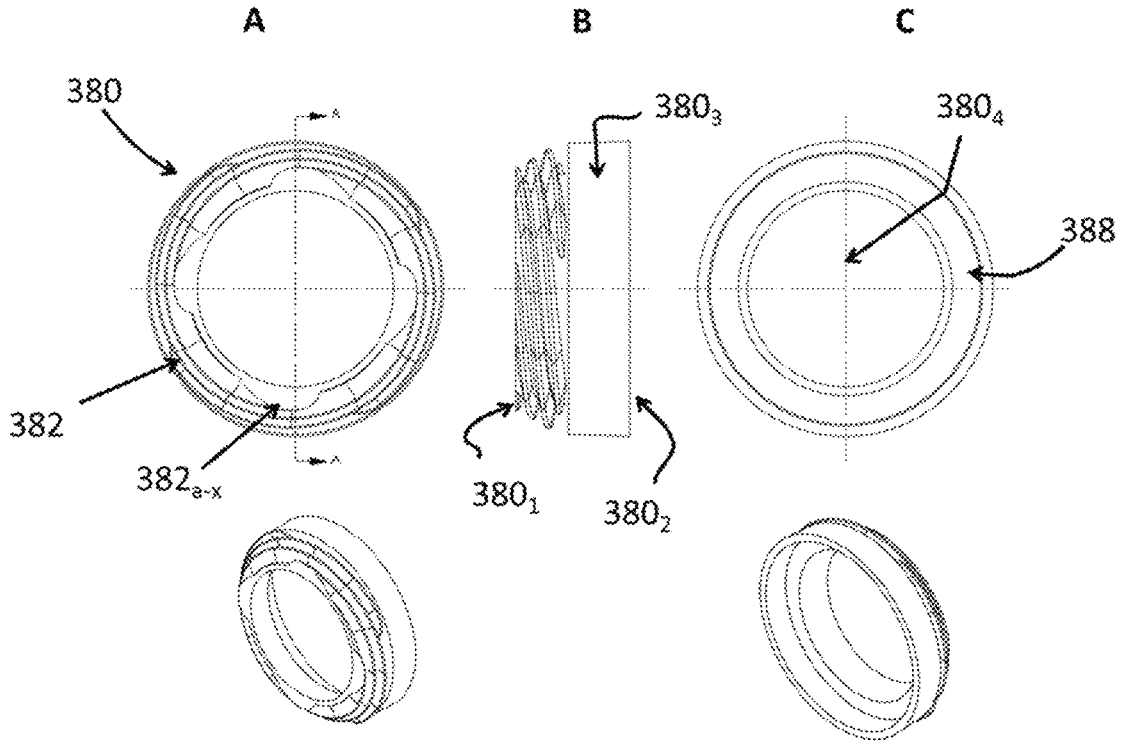
FIG. 11A shows front elevation (top) and side (bottom) views of a first side (A), a side view (B) and front elevation (top) and side (bottom) views of another side (C) of a tubing connection module according to one embodiment of the present disclosure.
Figure 11B:
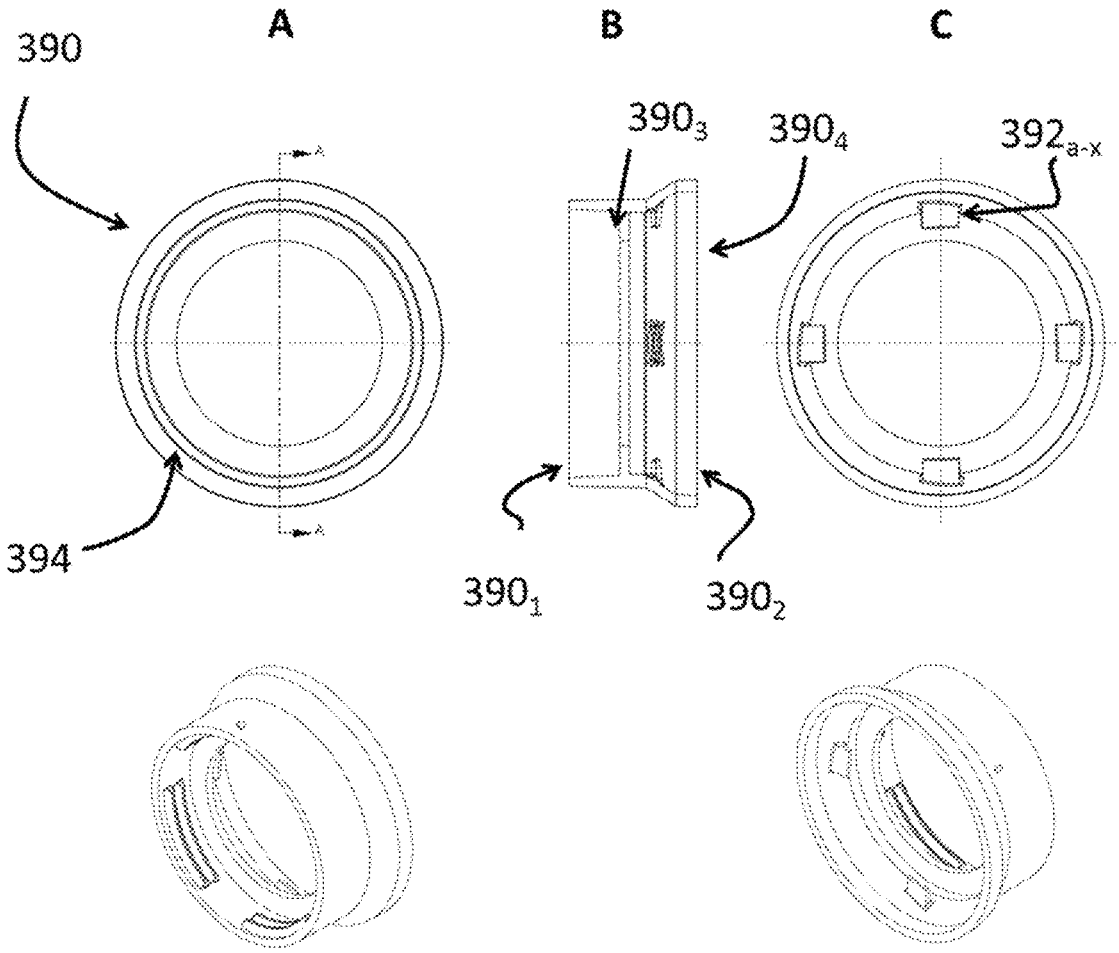
FIG. 11B shows a front view of a first side (A), a side view (B) and a front view of another side (C) of a tubing connection module according to one embodiment of the present disclosure.

The proximal end ($\mathbf{360}_2$) comprises a duct-to-injection outlet connector (380). In one embodiment, the duct-to-injection outlet connector (380) connecting the injection duct (360) to the injection tubing section (226) through the injection outlets ($\mathbf{230}_{a\text{-}x}$) is exactly the same as the duct-to-casing connector (370) shown in FIG. 10. In a preferred embodiment, the duct-to-injection outlet connector (380) has a distal end ($\mathbf{380}_1$), a proximal end ($\mathbf{380}_2$) and a wall ($\mathbf{380}_3$) joining the distal end ($\mathbf{380}_1$) to the proximal end ($\mathbf{380}_2$); the wall ($\mathbf{140}_3$) defining an internal lumen ($\mathbf{380}_4$) such as shown in FIG. 11A. The duct-to-injection outlet connector (380) connects the injection duct (360) to the injection outlets ($\mathbf{230}_{a\text{-}x}$) through an outlet connector (370). In some instances, the attachment system of the duct-to-injection outlet connector (380) comprises a plurality of spiral locking threads ($\mathbf{382}_{a\text{-}x}$) which may be our of phase from each other with a particular angle allowing to form an gas-tight seal (typically tighter than a single spiral thread) around the duct-to-injection outlet connector (380). In the embodiment depicted in FIG. 11A, the attachment system comprises four spiral locking treads 90° out of phase from each other. Alternatively, the attachment system (388) may be replaced by internal-external threads, or other attachment means such as, for example, Velcro™. In some embodiments, an attachment extension adaptor (390) may be used to connect two consecutive injection ducts (360) as a means to extend the reach of the system when required. The attachment extension adaptor (390) as illustrated in greater details in FIG. 11B, has a distal end (390$_1$), a proximal end (390$_2$), a connector wall (390$_3$) joining the distal end (390$_1$) to the proximal end (390$_2$) to define an internal lumen (390$_4$). The distal end (390$_1$) of the attachment extension adaptor (390) is shaped into an indentation connection system (394) suitable for connection or in some instance locking with the injection wall (360$_3$) of the injection duct (360). The proximal end (390$_2$) comprises one or more locking elements (392$_{a-x}$), in particular male connectors to connect two consecutive injection ducts (360). In one embodiment, the connections may be done through a duct-to-injection outlet connector (380).

In one embodiment, the connection between the injection outlets (230$_{a-x}$) and the gas injection devices (300$_{a-x}$) is an air-tight connection while allowing fluid communication (i.e., gas flow) between the distribution unit (220) and the gas injection devices (300$_{a-x}$). In another embodiment, the connectors (230$_{a-x}$) comprise a twist-fit connector such as the one shown in FIG. 11A. In some embodiments, the gas injection system of the present disclosure may be used to dry walls (e.g., drying mode). In drying mode, the gas injection device operates to inject gas into the wall with a speed and a duration that may be adjustable according to the degree of the water damage and the amount of dryness that is to be achieved following, in certain instances, the directives provided by the control and monitoring software (700).

In some other embodiments, the gas injection device of the present disclosure may be used to extract gas from a wall (e.g., from the cavity of a wall). In such embodiments, the gas extractor may be used to, for example, decontaminate a wall (e.g., decontamination mode).

In some embodiments requiring silent operation of the gas injection system (200), the gas injection device (300) further comprises a noise reduction module (not shown) similar to the one previously described. In such a case, the geometry of the duct-to-casing connector (362) is adapted to receive the noise reduction module (330).

Figure 12:
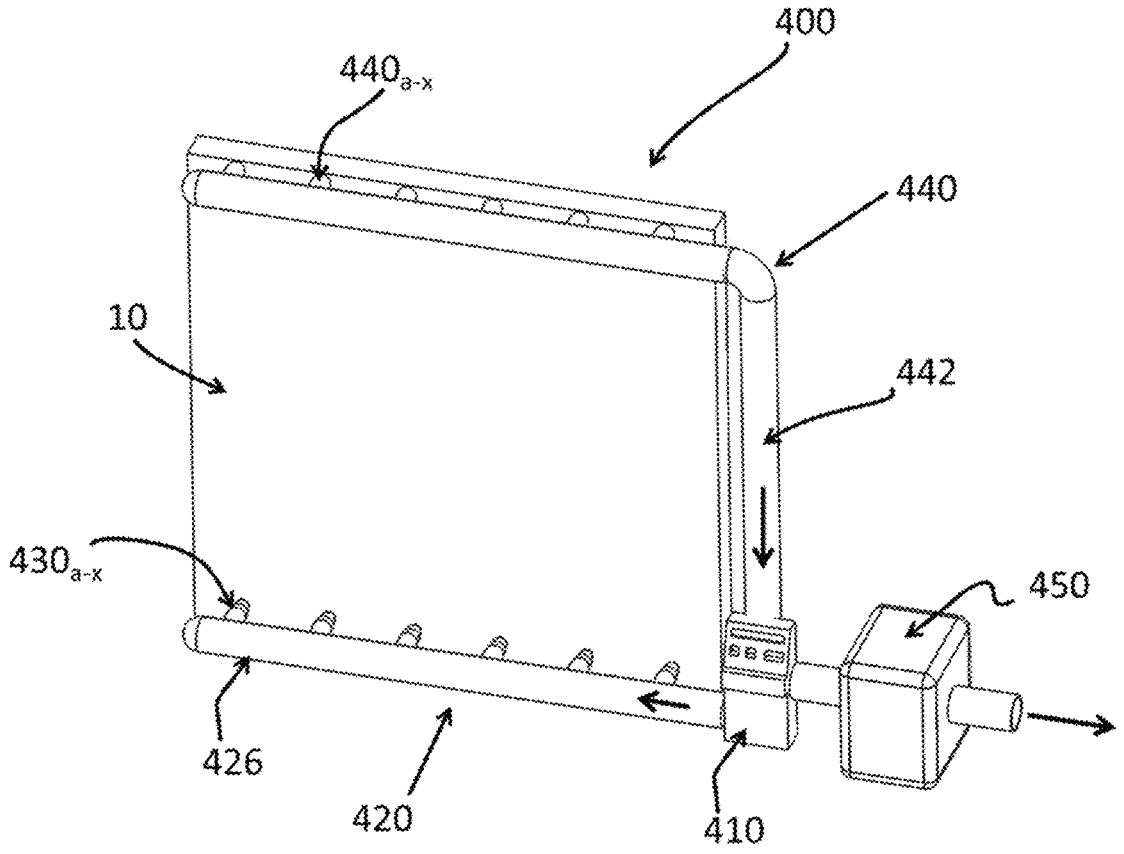
FIG. 12 shows a side elevation view of a gas decontamination system according to one embodiment of the present disclosure.

In some embodiments, the present disclosure provides a gas circulation system for circulating a gas into a cavity of a wall. An example of a gas circulation system (400) is illustrated in FIG. 12. In this embodiment, the gas circulation system (400) may be used to both dry and decontaminate a wall (10). In some instances, the gas circulation system (400) comprises a gas injection unit (420), a gas extraction unit (440) and a gas generator (410). In some instances, the gas circulation system (400) further comprises a gas destruction unit (450) to destroy substantially all or part of the gas extracted form the gas extraction unit (440). The gas injection unit (420) comprises one or more gas injection devices (430$_{a-x}$) and a gas distribution unit (426) in fluid communication with the one or more gas injection devices (430$_{a-x}$). The gas extraction unit (440) comprises one or more gas extraction devices (440$_{a-x}$) and a gas recirculation module (442) in fluid communication with the one or more gas extraction devices (440$_{a-x}$). The gas generator (410) generates gas and propels the generated gas into the internal lumen of the gas injection unit (420). The gas distribution unit (426) comprises outlets (426$_{a-x}$) that are connected to and in fluid communication with the gas extraction device (440$_{a-x}$) to allow injection of the gas from the gas distribution unit (426) through the gas injection device (440$_{a-x}$) and into the cavity of the wall (10). In turn, the gas extraction device (440$_{a-x}$) extract gas found into the cavity of the wall (10) and direct the extracted gas into the gas recirculation module (442) to the gas generator (410), thereby operating in closed loop for several cycles until the desired gas concentration and exposition time are attained. In some embodiments, the gas concentration and exposition time may be monitored remotely from the gas injection system and controlled via a control system, e.g., control software or program. The gas that is extracted from the gas extraction unit that does not need to return into the gas injection unit (420) is directed to the gas destruction unit (450) as will be defined here below.

Figure 13:
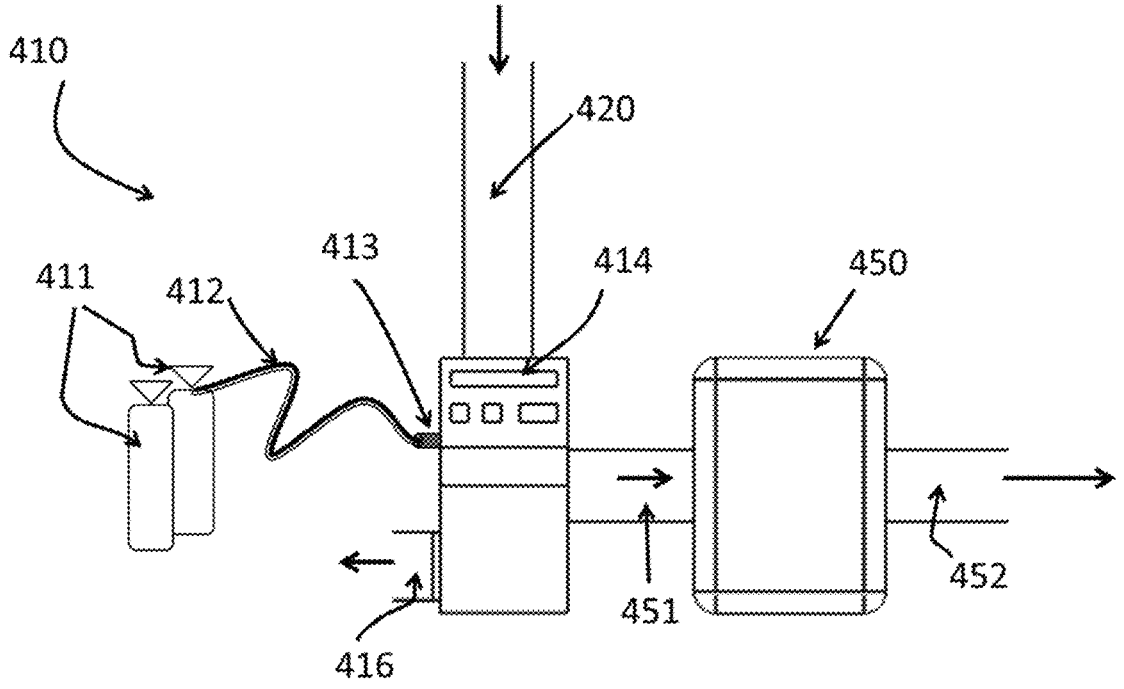
FIG. 13 shows a schematic representation of the gas generator and the gas destructor systems according to one embodiment of the present disclosure.

FIG. 13 shows an example of the gas generator (410) and gas destruction unit (450) in greater details. In this embodiment, chlorine dioxide is generated through a combination of chlorine and sodium chlorite supplied by gas tanks ($Cl_2$+Ni) and sodium chlorite cartridges (411) properly mixed and distributed to the gas generator (410) by means of conduit (412). The gas ($ClO_2$) enters the gas generator (410) through inlet (413). The gas concentration is controlled by monitoring system (414) as it is send to the gas distribution system through outlet (416). In one embodiment, commercial chlorine dioxide generators are used, such as Minidox-M® from ClorDiSys (Somerville, N.J., USA).

Once the gas circulating in the system has acquired the desired properties, the remaining gas is directed to the gas destruction unit (450) via a duct (451) located at the proximal end of the gas generator (410) and evacuated to the ambient or confined room or other via the evacuating duct (452). The concentration of gas found inside the room defined by the walls being dried and/or decontaminated may be monitored and may be an indication on the speed and duration of the drying and/or decontamination process. On a preferred embodiment, the treated space is confined within a hermetical containment, which acts as barrier to gas leakage to adjacent areas.

Figure 14:
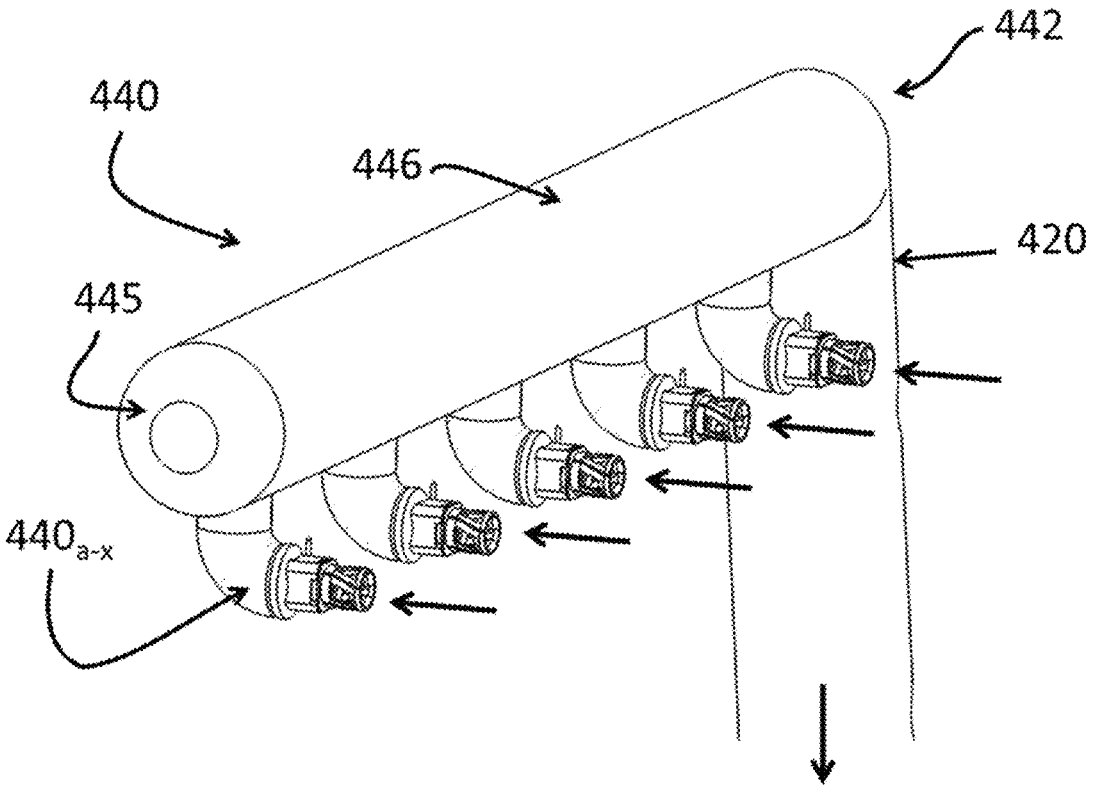
FIG. 14 shows a side elevation view of a gas recirculation system according to one embodiment of the present disclosure.

The extraction unit (440) is illustrated in greater details in FIG. 14. The gas recirculation module (442) comprising the plurality of gas extraction devices (440$_{a-x}$) that are connected to an extraction tubing section (446). The extraction tubing section (446) comprises a plurality of apertures for accepting the plurality of gas extraction devices (440-$_{a-x}$), each aperture of the plurality of apertures accepting a gas injection device (440$_{a-x}$). In some instances, the apertures are fabricated in situ and are substantially equidistantly separated, following for example an about 10 feet distance between apertures. It will be appreciated that apertures may be located at varying distances to accommodate to particular room geometries. The arrows (FIG. 14) represent the direction of the flow of gas in the decontamination mode. A stopper (445) may be used to close the extraction unit (440).

In the embodiment, wherein the gas injection device of the present disclosure is used as a gas extraction device, the ventilation module is set to expel the gas incoming from the injector module out of the casing module and out of the injection duct, which in such embodiment, could be said to be an extraction duct.

The devices and systems of the present disclosure can be operated through a power supply. For most applications, an AC power can be employed. Alternatively, a wireless configuration may be used for overcrowded spaces or areas with difficult access. In such instances, alternative energy supplies (or a combination of them) may be preferred such as, but not limited to: rechargeable batteries, solar cells, or the like.

Figure 15:
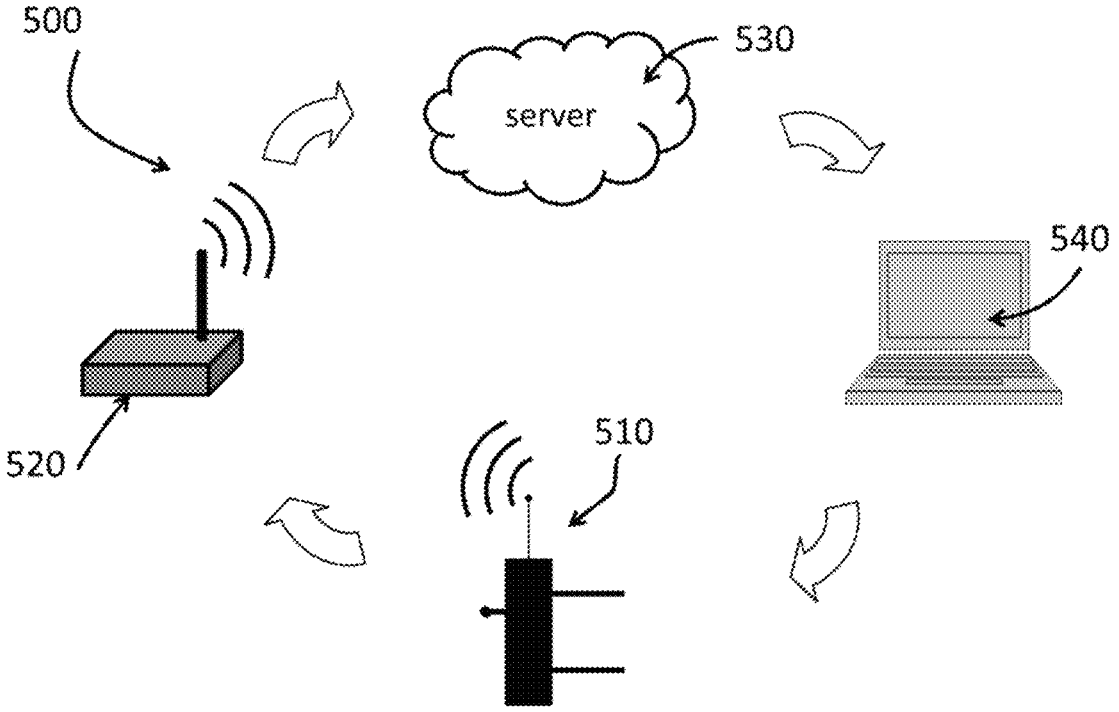
FIG. 15 shows a diagram showing a remote monitoring architecture according to one embodiment of the present disclosure.
Figure 16:
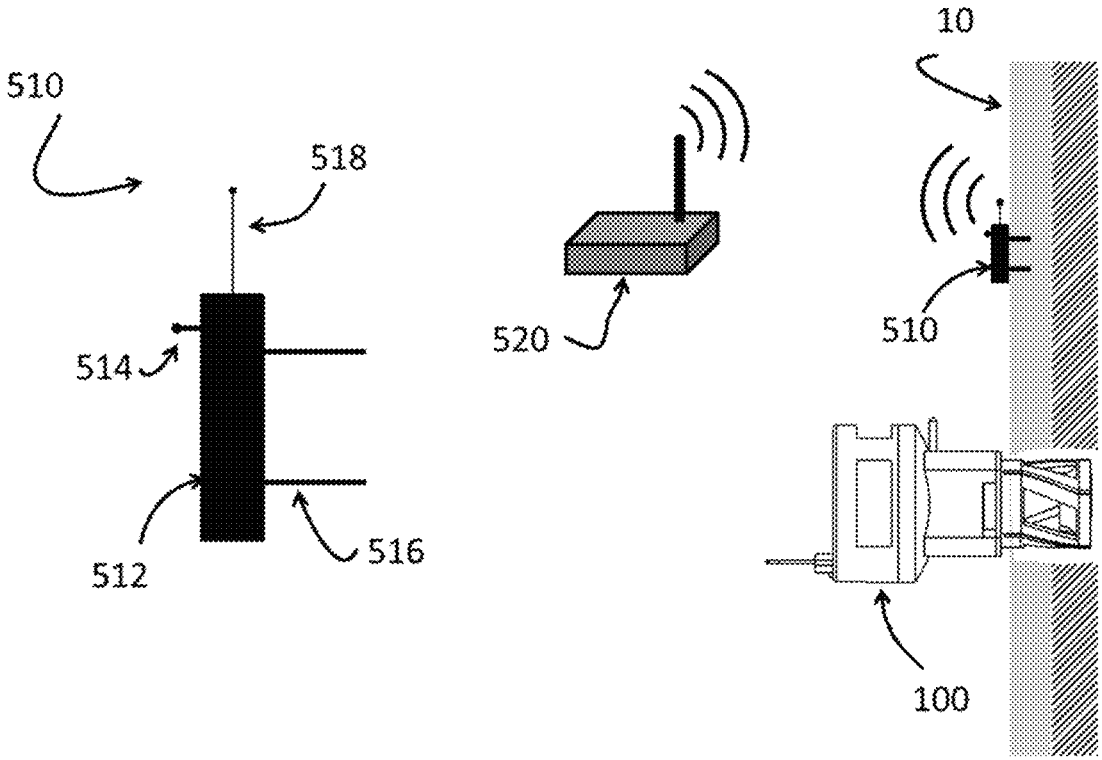
FIG. 16 shows a diagram of a wireless sensor according to one embodiment of the present disclosure.

In some embodiments, the gas injection device and the systems of the present disclosure may be monitored and/or controlled via a wireless connection as illustrated in FIG. 15. In this embodiment, the wireless connection (500) comprises a monitoring system (510) having one or more wireless sensors (510$_{a-x}$) in communication with the gas injection device and system of the present disclosure. The wireless sensor is also in communication with a gateway (520) located inside the building being treated. Data collected by the gateway (520) is sent to a remote server (530) via WiFi access or wireless mobile telecommunications. Data from the remote server (530) may be recovered with reading devices (540) such as PC, tablets or cellular phones. Examples of wireless sensors are illustrated in FIG. 16. The wireless sensors comprises a sensor casing (512) temperature and relative humidity detectors (514), water content probes (516) and an antenna (518) for remote communication. In one embodiment, commercially available protimeter wireless systems can be used such as HygroTrac® from General Electric (Boston Mass., USA).

In some instances, such as illustrated in FIG. 3, the gas injection device (100) comprises a wireless an electronic circuit board (512) and an antenna (513) to communicate with the control and monitoring discussed below via wireless connection (500).

Figure 17:
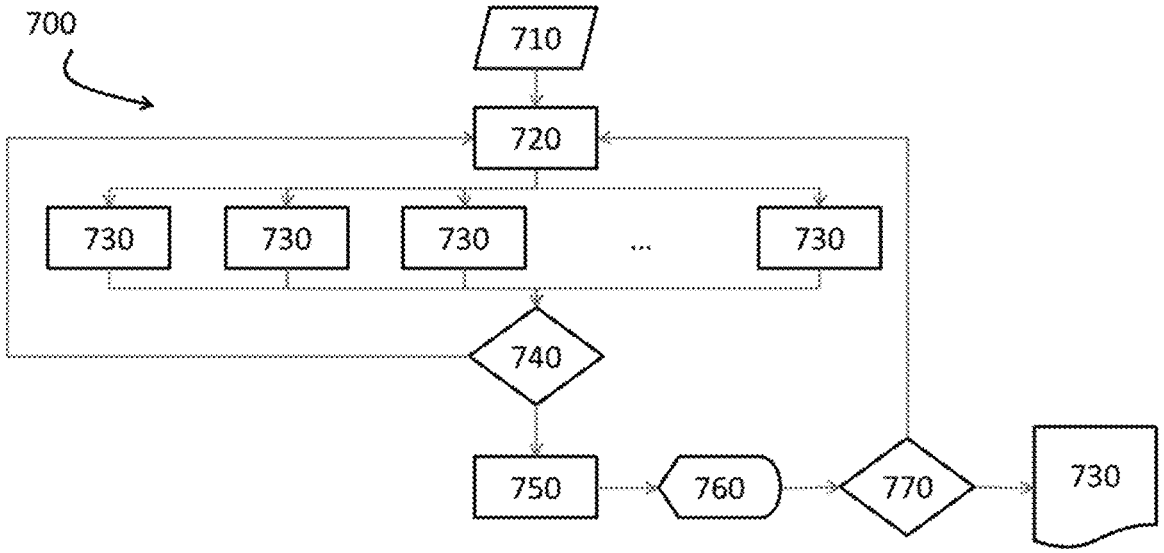
FIG. 17 shows a simplified flow diagram of the monitoring and control software.

In another embodiment, the present disclosure relates to a monitoring system for monitoring the progress of the gas injection device and the gas injection system defined herein via a control software (700) for which a simplified flow diagram is illustrated in FIG. 17. The user enters input parameters (710) into the system. The input parameters (710) include information such as, but not limited to, number of rooms to be treated, geometry and dimension of the rooms, types of materials present in the rooms (e.g., in the walls of the rooms), degree and type of damage to be treated (e.g., water damage and/or contamination), or the like. From the input parameters (710), the control software (700) runs a damage assessment subroutine (720) in order to classify the type and degree of damage and provide a first set of operating parameters (730) required to complete the task. The operation parameters include information such as, but not limited to, required equipment (e.g., type and quantity), manpower (e.g., number of qualified technicians), required electrical power, cost and delay estimation, and estimated time for drying and/or decontamination. Availability of resources required to complete the task is verified (740) and a drying and/or decontamination strategy (750) is proposed by the software. The operating parameters are re-calculated in case of lack of available resources, e.g. not enough equipment or manpower, until the revised operating parameters matches the available resources, in which case a strategy is proposed. During the drying and/or decontamination cycles, the software remotely monitors the evolution (760) and detects problems and triggers an alarm (770) in case of problems or when the drying and/or decontamination cycles are completed, in which case a report (780) is produced. Problems may include loss of contact with the equipment, abnormal levels of temperature, humidity, water content and/or gas concentration. Corrective measures can be undertaken remotely: adjustment of fan speed, targeted conditioned air temperature and/or relative humidity, gas concentration and exposition time.

It is understood that the data reported in the present specification are only given to illustrate the present disclosure and may not be regarded as constituting a limitation thereof.

While the present disclosure has been described in connection with specific embodiments thereof, it will be understood that it is capable of further modifications and this application is intended to cover any variations, uses, or adaptations of the present disclosure following, in general, the principles of the present disclosure and including such departures from the present disclosure as come within known or customary practice within the art to which the present disclosure pertains and as may be applied to the essential features hereinbefore set forth, and as follows in the scope of the appended claims.

All published documents mentioned in the present specification are herein incorporated by reference.

The invention claimed is:

1. A gas injection device for drying and/or decontamination of a building structure, the gas injection device comprising an injector module, the injector module having an inner lumen defined by an external wall, the external wall defining a distal insertion portion for insertion of the injector module into the building structure and a proximal ventilation portion for providing air flow into the inner lumen of the injector module, the distal insertion portion and the proximal ventilation portion being in fluid communication with one another through the inner lumen, wherein the external wall of the proximal ventilation portion comprises a plurality of ventilation openings configured to direct air flow into the inner lumen of the injector module.

2. The gas injection device as defined in claim 1, wherein the building structure is selected from a wall, a floor and a ceiling.

3. The gas injection device as defined in claim 1, further comprising an injector-to-duct connector attached to the proximal ventilation portion for connection of the gas injection device to an injection duct.

4. The gas injection device of claim 1, for injection of gas into a cavity in a building structure, the gas injection device further comprising:

a) a ventilation module;

b) a casing module for assembling the ventilation module with the injector module; and c) a noise reduction module connected to the casing module.

5. The gas injection device as defined in claim 4, wherein the injector module, the casing module and the noise reduction module each have an inner lumen in registration with one another to create an inner passageway for gas flow.

6. The gas injection device as defined in claim 5, further comprising a cap for closing the inner passageway.

7. The gas injection device as defined in claim 6, wherein the cap is connected to the injector module.

8. The gas injection device as defined in claim 4, wherein the ventilation module is inserted into the casing module.

9. The gas injection device as defined in claim 4, wherein the noise reduction module is connected to the casing module.

10. The gas injection device as defined in claim 4, wherein the injector module is suitable for insertion into a hole made in the building structure.

11. The gas injection device as defined in claim 10, wherein the injector module comprises a plurality of attachments for attachment of the injector module into the hole in the building structure.

12. The gas injection device as defined in claim 11, wherein the plurality of attachments are a plurality of protrusions extending from the injector module.

13. The gas injection device as defined in claim 4, wherein the casing module is attached to the injector module through a casing-to-injector connector and an injector-to-casing connector.

14. The gas injection device as defined in claim 7, wherein the capping module is attached to the injector module through a capping-to-injector connector and an injector-to-capping connector.

15. The gas injection device as defined in claim 4, wherein the building structure is selected from a wall, a floor and a ceiling.

16. A gas extraction device for drying and/or decontamination of a building structure, the gas extraction device comprising an extractor module, the extractor module having an inner lumen defined by an external wall, the external wall defining a distal insertion portion for insertion of the extractor module into the building structure and a proximal ventilation portion for providing air flow into the inner lumen of the extractor module, the distal insertion portion and the proximal ventilation portion being in fluid communication with one another through the inner lumen, wherein the external wall of the proximal ventilation portion comprises a plurality of ventilation openings configured to direct air flow into the inner lumen of the extractor module.

17. The gas extraction device as defined in claim 16, wherein the building structure is selected from a wall, a floor and a ceiling.

18. The gas extraction device as defined in claim 16, further comprising an extractor-to-duct connector for connection of the gas extraction device to an extraction duct.

* * * * *